US009074847B1

(12) United States Patent
Sullivan et al.

(10) Patent No.: US 9,074,847 B1
(45) Date of Patent: Jul. 7, 2015

(54) STABILIZED WEAPON PLATFORM WITH ACTIVE SENSE AND ADAPTIVE MOTION CONTROL

(71) Applicant: Flex Force Enterprises LLC, Portland, OR (US)

(72) Inventors: Jacob Ryan Sullivan, Portland, OR (US); John Holbrook Vance, II, Oakland, CA (US); Daniel J. Hyman, Long Beach, CA (US)

(73) Assignee: Flex Force Enterprises LLC, Portland, OR (US)

( * ) Notice: Subject to any disclaimer, the term of this patent is extended or adjusted under 35 U.S.C. 154(b) by 0 days.

(21) Appl. No.: 14/472,213

(22) Filed: Aug. 28, 2014

(51) Int. Cl.
*F41G 5/06* (2006.01)
*F41G 3/22* (2006.01)
*F41G 5/24* (2006.01)

(52) U.S. Cl.
CPC .. *F41G 5/06* (2013.01); *F41G 3/22* (2013.01); *F41G 5/24* (2013.01)

(58) Field of Classification Search
CPC ..... F41G 5/02; F41G 5/06; F41G 5/08; F41G 5/16; F41G 5/24; F41G 3/22; F41G 3/16; H04N 5/23264; H04N 5/23267; H04N 5/2328
USPC ..... 89/41.09, 41.11, 41.15, 202, 203, 204, 89/205
See application file for complete search history.

(56) References Cited

U.S. PATENT DOCUMENTS

| | | | | |
|---|---|---|---|---|
| 969,614 | A | 9/1910 | Florenz | |
| 1,507,209 | A | 9/1924 | Schneider | |
| 2,448,612 | A | 9/1948 | McLaren | |
| 2,487,062 | A | 11/1949 | Manes | |
| 2,554,019 | A | 5/1951 | DuBois | |
| 3,438,305 | A | 4/1969 | Nollet | |
| 7,210,391 | B2 | 5/2007 | Beckmann | |
| 8,322,269 | B2 * | 12/2012 | Sullivan et al. | 89/41.11 |
| 2004/0050240 | A1 | 3/2004 | Greene et al. | |
| 2007/0261544 | A1 | 11/2007 | Philippe | |
| 2008/0034954 | A1 | 2/2008 | Grober | |
| 2008/0048033 | A1 | 2/2008 | Quinn | |
| 2012/0062691 | A1 * | 3/2012 | Fowler et al. | 348/36 |
| 2012/0186440 | A1 * | 7/2012 | McKee et al. | 89/41.02 |

FOREIGN PATENT DOCUMENTS

EP 1580518 A1 * 9/2005

* cited by examiner

*Primary Examiner* — Stephen M Johnson
(74) *Attorney, Agent, or Firm* — Mintz Levin Cohn Ferris Glovsky and Popeo, P.C.

(57) ABSTRACT

A stabilized platform is provided with active sense and adaptive control is provided that allows an operator, during operation, to switch between an electrically assisted operational mode to a manual operational mode. Related systems, apparatus, methods, and articles are also described.

24 Claims, 10 Drawing Sheets

STABILIZED WEAPON PLATFORM WITH ACTIVE SENSE AND ADAPTIVE MOTION CONTROL

FIELD

The subject matter described herein relates to weapon sense and control methods and systems, including, but not necessarily limited to, the use of sensors to determine the motion of platforms containing crew-served weapons, and the use of actuators to counteract the motion of those platforms (e.g., stabilize) and further refine the aim points of said crew-served weapons. The general intention is to address the problems of crew-served weapon mounts for light and medium class mounted weapons, including, but not limited to, machine guns, mortars, grenade launchers, and rapid-fire cannons. A salient example would be a stabilized weapon platform for a crew-served .50 caliber machine gun on a patrol boat, which would sense the motion of the patrol boat and use electric actuators to keep the weapon aimed on its target regardless of the motion of the patrol boat, and would further allow precise aim adjustment through crew input from a joystick-type input device.

BACKGROUND

Light and medium class weapons are typically fired from weapon mounts that are themselves attached to a platform. Examples of light class weapons include the M2HB .50 caliber machine gun and the MK19 25 mm automatic grenade launcher. Examples of medium class weapons include a variety of 40×53 mm automatic grenade launchers, 25 mm chain guns, and 30×173 mm rapid-fire cannon. Examples of weapon mounts include crew-served weapon mounts such as rotorcraft door gunners and maritime weapon mounts, crew-served tripod mounts commonly used by dismounted soldiers (i.e., infantry, as opposed to serving as vehicle crew or riding in vehicles for transport), and a wide variety of fixed, flexible, skate-type, and other moveable vehicle weapon mounts. Examples of platforms include riverine craft such as the CCM and SOC-R, surface warfare craft such as the LCS, infantry fighting vehicles such as the M2 Bradley, multipurpose vehicles such as the HMMWV, main battle tanks such as the M1A2 Abrams, and rotorcraft such as the UH-1 Huey and UH-60 Blackhawk.

Traditional crew-served weapon mounts enable high situational awareness and high slew rates to reposition the weapon and engage multiple targets or provide suppressive fire. The use of snipers, ambushes, sneak attacks, and guerrilla tactics has increased in recent years, with a transition to combat and law enforcement activities in and around areas with populations of uninvolved civilians and non-combatants. In response, military and law enforcement leaders have emphasized the use of sensor systems, unmanned systems, and increased situational awareness of manned platforms to increase operational effectiveness while simultaneously reducing allied and civilian casualties as well as reducing collateral damage. Because of these operational goals and the heightened value of situational awareness and tactical flexibility, crew-served weapon mounts continue to serve our warfighters in the modern battlefield.

Crew-served weapon mounts, as well as other types of weapon mounts, suffer from systematic inaccuracies, as well as motion-induced, target tracking, and operator-specific inaccuracies. Crew-served weapon mounts in many operational scenarios also suffer from the risk of exhausting a magazine before the weapon is effectively brought to bear on a target when engaging under suboptimal conditions. What is needed are stabilization subsystem architectures, processing, and control methods that can effectively eliminate the largest inaccuracies that contribute to angular spread of crew-mounted weapons and other sensor and weapon mounts in a compact and cost-effective manner.

Numerous industry and government developers have designed and implemented various stabilization methods and systems for weapon and sensor mounts, wherein a stabilization subsystem is used to fix the position of a weapon (or camera) once aimed at a target using mechanical means. For the vast majority of these implementations, the stabilization subsystem fixes the position through physical locking mechanisms or gyroscopic spinning masses. Note that for the purposes of this discussion, an electromagnet-based locking mechanism is considered to be an equivalent to a mechanical locking mechanism, as the net purpose of any one of these mechanisms is to force the weapon to maintain its aim point by preventing it from aiming in another direction by means of mechanical (gyroscopic, electromotive, etc.) resistance to movement.

An example of the mechanical based stabilization means are the Mk49 (ROSAM) and Mk50 (Protector) remote weapon systems used by the United States Navy. Both of these systems use gyroscopes to measure the motion of the host platform and command a mechanical drive train to counteract the measured motion so that the weapon maintains the same aiming vector. Both of these systems also have an auxiliary mode of operation, wherein an operator can mechanically disengage the drive train so that he or she can manually slew and fire the weapon. Neither of these, or any other systems, allow the operator to switch from manual aiming to stabilized mode without physically disengaging the drive train nor do they allow an operator to locally adjust or "fine tune" an existing aim point at the weapon once stabilization is underway.

According to some researchers, an alternative method of weapon control is employed wherein electrical actuators control the weapon mount exclusively. A typical example is the remote turret weapon mounts commonly used on ground vehicles throughout U.S. and allied forces, covering a range of armaments from personal small arms through heavy cannon. In these systems, there is limited capability for a crewman to physically operate the weapon mount, as ballistic correction and stabilization benefits are provided only during remote operation. Even when crew operation is permitted, there is no ready availability of a true free-gunning mode, as the weapons have significant mechanical resistance due to gear trains and/or other coupled drive train elements. These must either be overcome physically by the crewman or be disabled with a specific mechanical procedure requiring time, training, and often risk to an operator who is typically required to move to an exposed position to perform the procedure. Furthermore, many small platforms have limited seating for crew and or mounted infantry to participate in a given mission. Converting a crew-served weapon station into a remote weapon station often removes one physical crew position that would have previously been available for personnel.

All of these attempts to develop and implement a weapon stabilization subsystem eliminate one or more of the critical advantages of crew-served weapon mounts. What is needed is a stabilization subsystem that preserves the intrinsic situational awareness, high slew rate, and personnel capacity of crew-served weapons, but still provides for accurate, precise, and effective engagement of targets.

SUMMARY

In a first aspect, an apparatus includes a stabilization assembly comprising one or more gimbals configured to be moved in one or more directions relative to a host platform, a payload cradle mounted to the assembly and configured to secure a payload mounted thereon, two or more electrical motion control actuators, one or more motion sensors sensing motion of the assembly in one or more inertial degrees of freedom, a control processor electrically interfaced with the two or more electrical motion control actuators and the one or more motion sensors, an interface selector control that enables selective switching between first and second operating modes during operation. In the first operating mode, the control processor automatically commands the two or more electrical motion control actuators based on motion data provided by the one or more motion sensors to stabilize an aim point of the payload by correcting for changes in payload aim caused by motion. In the second operating mode, the control processor automatically commands at least one of the two or more motion control actuators to disengage such that the payload and its assembly may be freely slewed by an operator.

The interface selector control can be mounted to the payload cradle or the payload. Gimbals can be provided for selectively positioning the payload.

There can be one or more payload controls provided for operation of the payload. Such payload controls can be mounted to or form part of the payload. In addition or in the alternative, the one or more payload controls can be mounted to or form part of the cradle or assemble.

The control processor can determine, based on data received from the one or more motion sensors, whether or not an operator is manning the payload. The control processor can determine, based on the data received from the one or more motion sensors, whether or not the operator has one hand or two hands on the payload controls.

The one or more gimbal controls can be configured adjust the aim point of the payload while in the first operating mode.

The payload can take various forms including a crew-served weapon (e.g., a projectile weapon, etc.), a camera, a light source (e.g., laser, etc.) and the like.

The sensors can include sensors such as inertial navigation systems (INS), global positioning systems (GPS), global navigation systems (GNSS), magnetometers, inclinometers, range finders, or radar sensors.

Environmental sensors can also be incorporated that measure at least one attribute selected from a group consisting of: altitude, temperature, humidity, air pressure, or wind conditions in direction and/or magnitude.

The host platform can be secured to a moveable vehicle. The host platform can be subject to motion comprising (i) rotational motion, (ii) linear motion, or (iii) a combination of rotational and linear motion.

A first actuator can be an elevation actuator, and a second actuator can be an azimuth actuator. A first motion sensor can be an elevation sensor and the second motion sensor can be an azimuth sensor. The motion sensor(s) can include sensors such as a gyroscope, an accelerometer, or a combination thereof. The motion sensors can detect motion in at least one of six degrees of freedom comprising pitch, roll, yaw, x, y, or z. The payload cradle can have two degrees of freedom relative to the host platform comprising azimuth and elevation.

Motion relative to Earth can be measured as well as the motion of the payload relative to the host platform. Movement of the payload can be operated remotely by an operator.

One or more target characterization sensors can be incorporated to generate data characterizing one or more of the motion, range, and speed of a target.

In another aspect, operation of stabilized platform is initiated in a first operating mode. Thereafter, a signal or input is received by an interface selector of the stabilized platform that switches the stabilized platform to a second operating mode. Operation of the stabilized platform in the second operating mode is then initiated.

In an interrelated aspect, a payload is stabilized by detecting the aiming orientation of a payload coupled to a gimbal assembly directed toward a target, wherein the gimbal assembly is mounted to a host platform and able to be moved in one or more directions relative to the host platform; reporting aiming orientation of the gimbal assembly to a stabilization computational device to calculate a first vector of the gimbal assembly; detecting and calculating host platform motion using one or more motion sensors sensing motion in one or more inertial degrees of freedom; reporting host platform motion to a stabilization computational device to calculate a second vector of the host platform motion; calculating a third vector from the first vector and second vector to generate an aiming correction command; transmitting the aiming correction command to a control unit comprising a first motion control actuator and a second motion control actuator, wherein the gimbal assembly is mechanically coupled to, and moved by, the control unit; correcting for the difference between an aiming orientation of the payload and the desired aiming orientation by using the aiming correction commands to the control unit to move the gimbal assembly and adjust the aiming direction of the payload; and allowing for the electrical engagement and disengagement of at least one of the motion control actuators such that the payload coupled to the gimbal assembly is configured to be freely slewed by an operator when disengaged without powering down the control unit.

The gimbal assembly can be configured to be freely slewed by an operator when disengaged without powering down the stabilization computational device.

A targeting mode can be selected such that the stabilization computational device calculates a desired aiming orientation that is more likely than other aiming orientations to enable the payload to effectively interact with, surveil, and/or engage the target.

In addition, operator initiated input can be received via an input device that detects direction and/or magnitude of a command by the operator to cause the aim point of the payload to be adjusted.

One or more of the following can be detected: payload configurations, target location, and/or target behavior to adjust operator input direction and/or magnitude to ease or assist the operator with aim point adjustment.

The computational device can be provided data that characterizes one or more of the host platform's location, attitude, and/or trajectory relative to the Earth's surface, such that a specific point in space may be targeted and tracked as the host platform moves. The data provided to the computational device can be derived from at least one of: an inertial navigation system (INS), global positioning system (GPS), global navigation system (GNSS), magnetometers, inclinometers, range finders, and/or radar tracking information.

A target mode can be selected such that the stabilization computational device tracks a point in space that moves along a vector of calculable direction and speed. The stabilization assembly can be configured to allow an operator to adjust the magnitude and direction of the velocity of the targeted point in space instead of the absolute position of the targeted point in space.

Environment data can be provided to the computational device to predict the environment's effects on the payload and/or target to further enhance targeting and/or tracking.

Target motion data can be provided to the computational device that is derived from one or more of a range finder, radar, video analytics, a targeting beacon, or other target tracking sensor.

The target motion can be either relative to the Earth's surface and combined with the host platform motion relative to the Earth's surface, or it can be directly measured relative to the host platform and provided to the computational device to calculate a correction vector.

Data can be provided to the computational device regarding the payload's interaction with the target. Such data can be predicted data for improved targeting and tracking of specific aim points of enhanced efficacy. Such data can be measured data for assessment of target status.

In one aspect, a method of stabilizing a crew-served weapon using a combination of sensors and electric actuators, so that the electric actuators compensate for and counteract the movement of the platform relative to a desired aim point. The method enables a functional combination of operator control and associated situational awareness with the addition of a stabilization subsystem for improved accuracy and precision delivery of weapon effect, thereby improving the effectiveness of crew-served weapons. Sensors provide data on the movement of the weapon platform relative to the desired aim point, and electrical actuators are used to counteract this movement so that a crew-determined aim point is maintained regardless of the movement of the platform.

In additional interrelated aspects, a method of control for weapon mounts including the ability to physically slew and fire the weapon in a similar manner as a traditional crew-served weapon mount, but also to power up and selectively engage and disengage a stabilization subsystem. This method of control allows for the weapon to be physically moved in a "free gunning" manner in both the zero power and disengage modes, which is highly desirable when multiple targets need to be engaged at wide angular spacing, or when engaging one or multiple targets under high rates of relative movement, or when suppressive fire is required across a large angular spacing. When precision fire is required, the weapon crew is able to hold the aim point by engaging the stabilization mode, which maintains the aim point regardless of platform and crewman movement. When the original target is no longer a priority, the crew can disengage stabilization and return to free-gunning.

In other interrelated aspects, a method of control for weapon mounts that has the ability to physically slew, fire, engage, and disengage stabilization, but that also includes an input for relative motion control. Relative motion control allows for the crew to modify the target aim point once stabilization has been engaged using a joystick, control pad, thumb wheel, or other input controller. This enables the adjustment of a stabilized aim point, either to correct an incorrect slewed-and-stabilized aim point, or to track a target that is moving relative to the platform and not compensated for by the stabilization subsystem. Tracking relative motion control can allow for coarse and/or fine relative motion control based on the specific input devices and actuators employed.

In other interrelated aspects, the control system response to sensor data input can be dynamically assigned based on sensor and operational states as well as recently processed data sets and other situational and environmental factors. Control system response weighting factors may be assigned based on pre-determined or dynamically assigned values prior to or throughout operation depending on how and where the system is used, or on what additional sensor and operational data is available, as well as what type of targets and environmental conditions are expected. Examples of such modified control system response includes the variation of joystick sensitivity relative to scope field of view, either between different scopes or for a single scope with different field of view settings. Another example includes the variation of joystick sensitivity displaying increased speed (reduced sensitivity) when engaging targets identified as having a higher angular velocity relative to the viewer. Another example would be to change the presence of or nature of crosshairs based on range and bullet drop, or replacing crosshairs with circular/ovoid reticle in the dispersion direction of varying wind conditions. This change in user interface could be coupled to a change in target tracking and other data processing techniques suited to rapidly changing environmental conditions.

In a separate interrelated aspect, a method of compensating for the recoil of a weapon in a weapon mount based on the mechanical characteristics of the weapon, mount, and the time the weapon is fired. Furthermore, recoil compensation with predictive models is enabled, wherein a stabilization subsystem predicts how the next shot in a burst is likely to be off target, and changes the aim of the weapon between each shot to compensate. Including sensor data during and/or after the shot is fired enables further stabilization of the weapon aim point and increased precision of the next shot fired.

Further interrelated aspects incorporate compensation for the recoil of a weapon based on the characteristics of the weapon, mount, and crew presently operating the weapon. Weapons can have operator-dependent reactions to firing, and these differences are accommodated and compensated for in this interrelated aspect of the present subject matter. Operator-dependent weapon mount control can be based on predictive models of a given operator (e.g., open-loop control), based on real-time sensor data (e.g., reactive closed-loop control), or both.

In a system-based interrelated aspect, a method of weapon stabilization would be incorporated into a crew-served weapon, including a crew control grip as well as a set of sensors, actuators, and processing resources. The control grip would provide for normal weapon operation, but have additional controls for turning on/off and engaging/disengaging the stabilization system. The set of sensors would detect the vertical, horizontal, and sideways motion of the weapon relative to the platform, as well as rotational pitch, yaw, and roll. The set of actuators would include the capabilities to aim the weapon in both the horizontal (pitch) and vertical (elevation) directions effectively within the limit of the actuator angular or linear range. The processing resources include the hardware needed to run a signal processing algorithm that analyzes the sensor data and sends control commands to the actuators to adjust the aim of the weapon.

In a further system-based interrelated aspect, a method of weapon stabilization that further incorporates an input device for relative control of weapon aim point onto the crew control grip. The input device provides for the crew to adjust the aim point of the weapon while it is otherwise stabilized. Electrical control commands from the input device are processed by the signal processing algorithm and layered atop its motion control scheme for counteracting the motion of the platform. The end result is that the operator can make fine or coarse adjustments to aim without having to disengage stabilization, which provides a desirable option for crew-served weapons requiring precise targeting or operation in adverse conditions of high platform motion.

In a further system-based interrelated aspect, the weapon stabilization system allows for the ability to adjust the aim point of the weapon to track a target identified from sensor data. In such a crew-served weapon system, an optical or radio-frequency sensor will provide targeting input to the crew and the control system. The weapon stabilization subsystem processor will incorporate this data into the stabilization and aim adjustment commands given to the actuators. In some variations of this system-based aspect, the weapon stabilization subsystem processor will only adjust the aim of the weapon upon a separate command given by the operator or other member of the crew. In some variations of this system-based aspect, the weapon stabilization subsystem processor will adjust the aim of the weapon based on target type, location, and relative movement, and automatically compensate for relative speed and time of flight (e.g., target-dependent kinematic leading). In some variations of this system-based aspect, the sensors used are mechanical, motion, or vibration-based sensors, and the target tracking is performed based on the data provided by those sensors. In some variations of this system-based aspect, sensors may be co-located with the weapon platform, and in other variations, sensors may be located at or near the target, and in yet other variations, sensors may be located a distance away from the weapon platform as well as a distance away from the target.

In some variations one or more of the following additional controls associated with target acquisition and tracking can optionally be included. The range to the target may be set manually, by a range finder, by controlling a laser designator or pointer, or incorporating data from a radar or optical sensor system. A separate control can be used to turn ballistic correction on or off. A separate control can enable automatic slewing of the weapon to aim at a target detected by a sensor (e.g., pre-shot or post-shot detection sensor system). A separate control can enable or disable engaging optical target tracking. A separate control can enable or disable engaging radar target tracking. A control can toggle the automatic slewing of the weapon to aim at one or another of multiple targets acquired by sensor systems.

In some variations one or more of the following can optionally be included. Power to the weapon stabilization subsystem can be turned off by a primary operator as well as by another crewman and/or by an automated safety system. Upon powering down, the weapon stabilization subsystem can quickly move to a free-gunning status, a safe position (e.g., weapon barrel up), or other state or position. Upon identifying a system fault, the weapon stabilization subsystem can quickly move to a free-gunning status, a safe position (e.g., weapon barrel up), or other state or position. In some variations, the definition of a safe position or other state or position can be reconfigured for a given mission or dynamically for a given operating condition during a mission. In some variations, the safe position can be adjusted based on the presence or lack of presence of allied forces and/or noncombatants.

In some variations one or more of the following can optionally be included. The weapon stabilization subsystem can consider a known target location as a relevant input, such as a location and/or range information provided by a laser designator or other sensor. The weapon stabilization subsystem can consider a suspected ally or noncombatant as a relevant input, such as a location, transponder, or activity type correlating with allied forces and/or noncombatants. In such cases, the weapon control system may be configured to prevent a known intrinsic angular weapon spread from overlapping significantly with the known or suspected angular directions where a shot fired would have an unacceptable likelihood of harming an ally or noncombatant, or, in an alternative configuration, prevent the firing of the weapon in specific directions when risk to allied forces or noncombatants is sufficiently large. In some variations, regardless of whether or not the operation of the weapon or stabilization is affected, the operator may be alerted to the presence of a detected or anticipated problem of risk to allied forces or noncombatants. In some variations, an alert may be broadcasted to allied forces or noncombatants to the potential risk, so that they may leave the potentially affected area, take cover, or otherwise alter behavior in a manner to reduce risk.

In some variations one or more of the following can optionally be included. The weapon stabilization subsystem can consider range and known environmental conditions to adjust the aim point for range drop and other projected projectile movement. The weapon stabilization subsystem can make aim adjustments quickly before each round is fired, and then reset to the nominal aim point for the crew quickly thereafter. Aim adjustments may be made faster than the operator can detect them, so that compensation for mechanical weapon, mount, recoil, range, and/or environmental effects can be made without visibility to the crew.

Non-transitory computer program products (i.e., physically embodied computer program products) are also described that store instructions, which when executed by one or more data processors of one or more computing systems, causes at least one data processor to perform operations herein. Similarly, computer systems are also described that may include one or more data processors and memory coupled to the one or more data processors. The memory may temporarily or permanently store instructions that cause at least one processor to perform one or more of the operations described herein. In addition, methods can be implemented by one or more data processors either within a single computing system or distributed among two or more computing systems. Such computing systems can be connected and can exchange data and/or commands or other instructions or the like via one or more connections, including but not limited to a connection over a network (e.g. the Internet, a wireless wide area network, a local area network, a wide area network, a wired network, or the like), via a direct connection between one or more of the multiple computing systems, etc.

The subject matter described herein can provide, among other possible advantages and beneficial features, systems, methods, techniques, apparatuses, and article of manufacture for stabilizing a crew-served weapon, enhancing weapon efficacy by increasing the number of rounds on target, reducing collateral damage and risk of harm to allied forces and noncombatants near to or beyond the target, and reducing the weight and cost of ammunition load-out, as fewer rounds are required for mission success. Implementations of this subject matter could provide critical tactical overmatch advantages, as crew-served weapons with weapon stabilization subsystems can engage targets at increased range, accuracy, and precision, which can save lives, materiel, and cost of operations.

The subject matter described herein can also provide, among other possible advantages and beneficial features, systems, methods, techniques, apparatuses, and article of manufacture for stabilizing weapon mounts other than crew-served weapon mounts, such as fixed-forward weapon mounts on rotorcraft, fixed-wing aircraft, autonomous ground, water, and air vehicles, and other platforms. In such applications, additional control functions would be incorporated into the normal controls for the operator of the weapon station, whether they are a pilot (or other crew in the vehicle itself) or operating remotely.

The details of one or more variations of the subject matter described herein are set forth in the accompanying drawings and the description below. Other features and advantages of the subject matter described herein will be apparent from the description, drawings, and claims.

DESCRIPTION OF DRAWINGS

The accompanying drawings, which are incorporated in and constitute a part of this specification, show certain aspects of the subject matter disclosed herein and, together with the description, help explain some of the principles associated with the disclosed embodiments. In the drawings.

DETAILED DESCRIPTION

Figure 1:
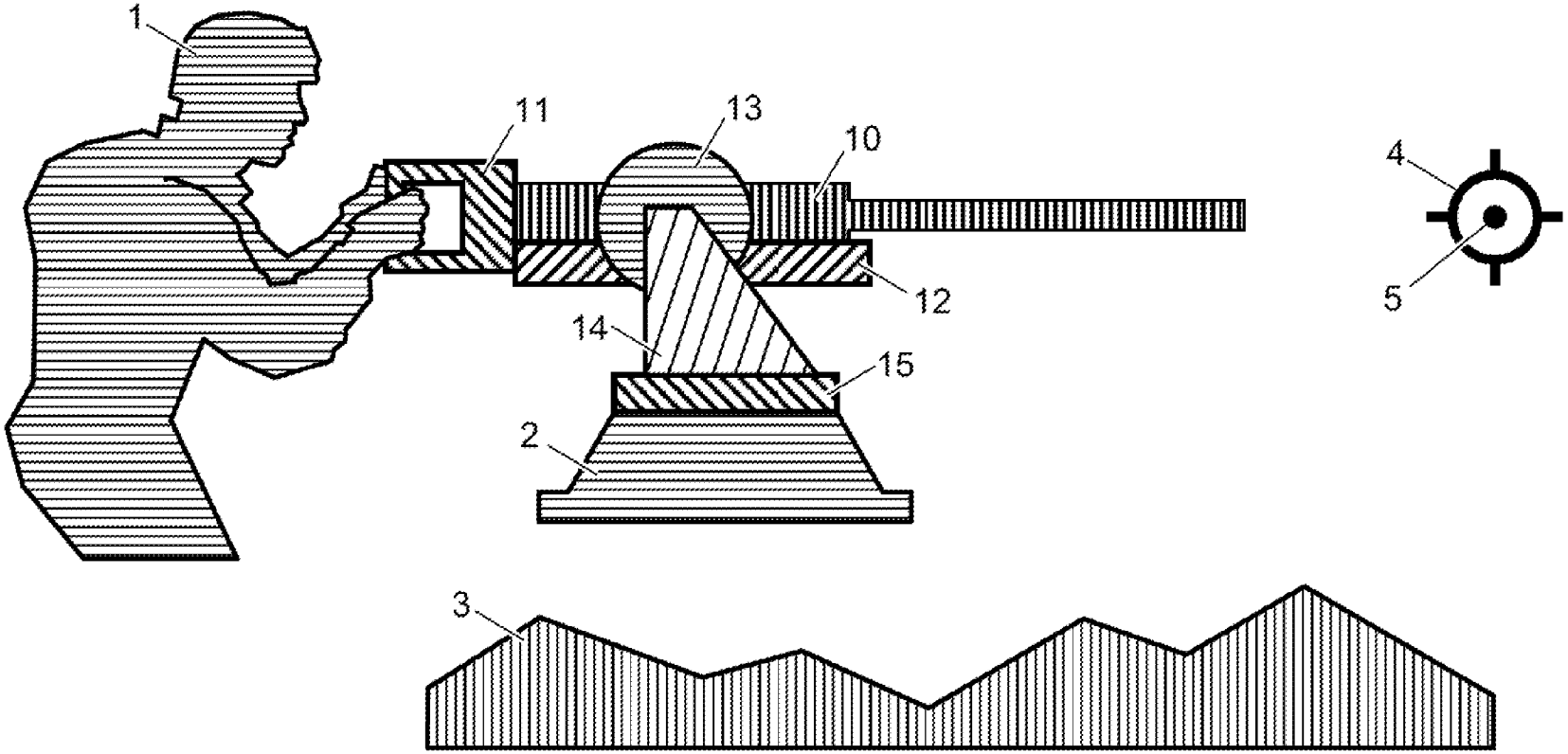
FIG. 1 is a side-view schematic illustration of an example crew-served weapon mounted on a stabilized weapon platform, wherein the weapon is directed at a target while the platform is in motion over undulating terrain.

The subject matter described herein can provide new weapon stabilization techniques for improved accuracy and precision of projectiles and munitions. Military operations and security missions of many types can be improved by employing the subject matter, as improved accuracy enables an overmatch condition between the light and medium class weaponry of U.S. and allied forces compared to light and medium class weaponry of enemy combatants and criminal entities. Maritime applications to counter enemy operations and piracy can be improved in mission effectiveness and reduced resource allocation, as the current subject matter significantly increases the effective engagement range and kills-per-loadout of the weapons used by military and security forces. Law enforcement and domestic security operations across a range of anti-smuggling and port security applications can be similarly improved. Additional benefits of the current subject matter are to reduce collateral damage and risk to friendly forces, non-combatants, and innocents. Additional benefit of increased effectiveness, operational cost savings, and reduced collateral damage can be gained by combining the current subject matter with other passive and active sensor technologies, and by deploying personnel with additional training in systems using the current subject matter in applications and missions with higher risk profiles and more challenging requirements.

When a weapon is aimed at a target and fired, there is a chance that the projectile or munition will hit its target, a chance that it will not hit its target but still harm the target in some way, a chance that it will not hit its target and have no effect. In addition to these chances of affecting the target, there are also chances of hitting or otherwise negatively affecting other objects downrange, which may include allies, non-combatants, or their property or possessions. The vernacular of targeting includes the term "accuracy" which refers to the aiming of the weapon in the proper direction to achieve the desired effect on a target. Such a term often refers to the ability to aim the weapon directly at the target, but this is not necessarily true (e.g., using indirect fire or engaging at long ranges with significant bullet drop). The vernacular of targeting also includes the term "precision" which refers to the exactness that a projectile, when aimed in a particular direction, will end up traveling in a path that matches the particular direction selected. In the field of weapon targeting, a lack of "accuracy" or a lack of "precision" most likely results in a projectile failing to achieve its intended effect, or, worse yet, may achieve a much worse effect in terms of allied and noncombatant casualties. The end result of a lack of accuracy and a lack of precision are often equivalent, and are regarded as the same term "inaccuracy" in this matter. Fortunately, inaccuracy due to a lack of accuracy and inaccuracy due to a lack of precision can each separately and together be partially or wholly compensated for using different but related techniques in an implementation of the present subject matter.

A wide variety of inaccuracies are intrinsic to a given combination of user, weapon, projectile, target, and environment. These inaccuracies can be correlated to the angular cross section of the target and efficacy profile of the weapon being fired relative to the hardness of the target, etc. to provide a likelihood of a shot achieving the intended effect. Different inaccuracies provide different likelihoods of angular spread (and other, more complex mathematical shapes in three dimensions over time) types of inaccuracies combine to widen the "spread" of effect for a given weapon. These inaccuracies can be layered or added together through convolution, statistical analysis, probability analysis, and other techniques to determine a single larger model of the inaccuracy of the particular moment in time for the given user, weapon, projectile, target, environment, and other conditions.

It is instructive to note that the user is a critical element in the definition of a targeting system, particularly for crew-served weapons. Training and experience, for example, can greatly reduce and narrow the scope of operator-specific inaccuracies, and can reduce the effective magnitude or end effects of all other types of inaccuracies as well. A veteran crewman, for example, might learn to lead certain types of targets differently, which would reduce the effective magnitude of kinematic targeting in the system. A veteran crewman might choose not to fire when a vehicle is undergoing severe motion when non-combatants or allied forces might be in an aggravated spread of effect, which would transform the end effect of the combined inaccuracies in the system from a risk of allied casualties into a new end effect of delayed target engagement with its own new set of consequences, risks, and mission impact.

Systematic inaccuracies represent the natural variance of projectile spread for a given weapon in a given mount using a given type of ammunition to fire upon a stationary target. Systematic inaccuracies include well-known factors such as motion due to wind, which are often partially, majority, or essentially accounted for by trained operators using sensors and sighting aids. These factors vary due to local changes in environmental temperature, pressure, and microclimates throughout flight, which may or may not be measurable or accurately predictable based on the sensors and data available to the operator of a given weapon. Systematic inaccuracies include variance intrinsic to a type of weapon and kit, such as a barrel type from a specific manufacturer, differences in barrel cleanliness, as well as variance specific to ammunition used (which can further affect differences in barrel cleanliness, kinematic drop, and other inaccuracy factors).

For example, there are many different types of .50 caliber rounds (and manufacturers thereof) that can be fired out of an M2HB machine gun, and each has its own characteristics for the variance of bullet drop, cross-wind tolerance, etc. as contributors to systematic inaccuracy. Each of these rounds also seats differently in the chamber, and has different variances with which they seat in the chamber, and these variations provide systematic variance in how their projectiles accelerate and spin when fired. The specific platform for the weapon mount, including the hardware used to bolt the weapon to the mount, and the mount to the platform, will also have its own systematic inaccuracy contribution, and this mechanical assembly contribution has time-varying factors both on the micro-scale (movement during recoil during a burst), local-scale (temperature changes during flight), and macro-scale (creep and fatigue in weapon mount hardware over the lifetime of the system).

The timing of weapon fire on the micro-scale during operation (e.g., whether firing the first, second, or third shots in a burst of automatic weapon fire) can define the way some mounted weapons fire as an aspect of systematic inaccuracy. These mounted weapons typically have predictable inaccuracies in how each of these shots are fired, and are inaccurate in repeatable ways due to the mechanics of the weapon and the mechanics of the weapon mount, and their responses to the recoil of the weapon as it fires. Each shot in a burst can have different aim points and systematic inaccuracy characteristics, and these will reset locally over time once a burst is ended. These time-varying systematic inaccuracies can be theoretically and/or experimentally defined, modeled, and predicted accurately for some weapon and mount combinations, and even for combinations of specific weapons, ammunition, and mounts. Note that theoretical models and simulations of these inaccuracies are likely to be different than experimentally obtained data for these inaccuracies for most weapons and weapon mounts, and the use of either or both in predicting projectile behavior is preferable to using neither.

Passively suppressing or actively counteracting macro-scale weapon and weapon mount changes for a particular mechanical mount can be part of a recoil damping subsystem. Recoil damping or recoil suppression has long been a part of weapon and weapon mount design, and incorporating some combination of passive and active recoil suppression (or active recoil anticipation-and-counteraction) can be desirable.

Target tracking inaccuracies includes the ability to track a target moving at high angular velocities relative to slew rate and other weapon mount characteristics, as well as the inability to predict where a target will be located in a future time. Time of flight is important for calculations of target kinematic leading, which is the process of aiming ahead of a moving target such that the projectile will intercept the target's future location. Kinematic leading in crew-served weapons is typically based on crew experience, to slew the weapon ahead of the target at a rate and angular difference based on target type, location, and relative movement, and is a well-known concept used throughout the history of warfare. The concept of target-dependent kinematic leading is also a well-known concept (e.g., "you don't lead [some targets] as much"), but, prior to the present subject matter, these capabilities have not been provided to crew-served weapon mounts in any automated fashion.

One fundamental aspect of target tracking inaccuracy is effective range and projectile drop under measured or estimated environmental conditions. This must include both the projected drop, the anticipated variance of this drop, and how this variance interacts with systematic variance of the weapon, ammunition, mount, etc. Furthermore, the longer the range, the greater the time of flight, and hence likelihood that certain types of targets will change direction and mitigate or eliminate the value of the kinematic leading attempt.

Range examples are important to aid weapon system designers and operators with a relevant and feasible set of operating capabilities. Distances for engaging targets with light and medium class weapons vary significantly with operational details such as target type, terrain, available lighting, sensor information confirming or otherwise identifying enemy combatants, and many other factors. A set of ranges for engaging targets with a crew-served .50 caliber machine gun in littoral applications, for example, might be as low as 20 m or less in night-time operations in brown water having dense foliage on river banks, or ideally well beyond 1 km in daytime calm weather engaging targets in open terrain or off-shore. Ranges for engaging targets with a rotorcraft mount might be as short as 50 m or less at high relative velocity for a strafing run to well beyond 1 km at low relative velocity for a standoff engagement with targets in open terrain. Ranges for medium-class weapons can be even longer, with maximum effective ranges up to 3 km or more for certain combinations of weapons and ammunition types.

A light class weapon projectile, such as a .50 caliber M33 ball, can have muzzle velocities of around 900 m/sec, a speed that drops throughout its time of flight due to air resistance and other factors. Light-class grenade launchers, by comparison, such as the Mk 19A, have subsonic muzzle velocities of around 250 m/sec. Medium class weapons can have even higher muzzle velocities up to 1,100 m/sec. These velocities mean that projectile time of flight can be in the range of a few hundredths of a second at short range up to ten seconds or more for subsonic grenades and mortar rounds launched at targets near their maximum range.

As an instructive example of range and timing calculation, consider a weapon stabilization system with enhanced target tracking firing an M2HB .50 caliber machine gun with M33 ball ammunition. The target is at a range of 1750 m to the north, and is also moving 10 m/sec to the east. Assume the M33 projectile travels at 900 m/sec for the first second of flight, and 850 m/sec during the following second of flight (a simplification for the purposes of illustration), so the time of flight will be about 2 sec. Meanwhile, the target will have moved 20 m to the east, far from the original aim point by the time the projectile arrives. If the target speed and range is known, a priori, and the environment between the firer and target can be measured or estimated (wind speed, air pressure, temperature, etc.), then the aim point for the weapon can be adjusted to aim 20 m to the east, or a radial change of about 0.65 degrees prior to firing.

Motion-induced inaccuracy is due to the movement of the mounting platform itself, and this can often be significantly higher than systematic, target tracking, and operator-dependent inaccuracies. When the platform is moving relative to the target, an additional inaccuracy is layered atop the systematic inaccuracy, and the overall spread of weapon effect increases. The increased area of effect can be an order of magnitude larger with even mild motion of the platform (e.g., 5-10 mph ground speed over typical dirt/gravel roads) or when tracking moderate-speed moving targets (e.g., 3-6 degrees per second relative angular velocity for a typical light weapon mount). At greater platform motion and high relative angular velocities, the area of effect can be across two or three orders of magnitude greater angular spread, with some weapons ceasing to become effective at all at any but the shortest engagement ranges. As an example, a riverine patrol craft in coastal waters at moderate speed with moderate wind conditions cannot effectively engage marine targets (e.g., pirate or smuggler panga boats) with a crew-served M2HB .50 caliber machine gun beyond an effective range of 200 meters. The angular spread of shots fired is large, so there is very little chance of achieving the hits required to neutralize the target given a limited supply of ammunition.

The purpose of stabilization is to reduce one or more of the many sources of inaccuracy when a given weapon is being fired. Stabilization provides enhanced accuracy and precision of payload delivery, whether kinetic energy projectiles (e.g., bullets), ordnance (e.g., cannon shells), or some other stand-off force projection. If a weapon is perfectly stabilized to account for the largely predictable inaccuracies of projectile drop, environment, and weapon mount (with time of fire), motion-induced inaccuracy, target tracking inaccuracy, and possibly even operator-dependent inaccuracy, then the only remaining sources can be the inherent inaccuracy of the weapon configuration itself and the intrinsic variance in the specific type/manufacturer of the ammunition being fired. These intrinsic inaccuracies are typically very small (e.g., milliradians for a properly maintained M2HB in the middle of its barrel operating life firing MILSTD M33 ball ammunition), so a perfectly stabilized weapon with a priori knowledge of environmental conditions and target tracking can be extremely accurate in its aim point as well as reproducibly precise in projectile delivery.

Although there are a number of stabilization subsystems and weapon mount control schemes that have been developed and implemented, no present stabilization and control system enables all of the desirable modes of operation provided by crew-served weapon mounts. Desirable modes include a stabilization mode which keeps the weapon aimed at a particular target, a free-gunning weapon with no system participation at the press of a button or flip of a switch, and a stabilized mode which holds the weapon still relative to the host platform or moves and holds the weapon into a safe position if the operator releases control. Other desirable modes of operation and capability are similarly lacking in these systems, other than a handful of remote-controlled weapon mounts that have layered on kinematic targeting and sensor fusion for target acquisition and range-finding. Even these systems, however, universally lack the situational awareness of manned crew-served weapon mounts, and the precise active control to compensate for platform movement while performing kinematic targeting and systematic inaccuracy compensation.

In the related operational environment of electromagnetic sensor and communication systems such as narrow-beam optoelectronic systems, laser target designators, and high-gain radar, a similar stabilization problem arises with respect to maintaining an aim point on a target under conditions of platform movement. A crew-served sensor head on a moving platform, for example, may require more precise aiming than would otherwise be possible without stabilization.

In the field of light and medium class weapon mounts, the typical motion stabilization problem is characterized by the pitch, roll, and yaw of the host vehicle, the relative translational motion of the host vehicle and target, and the flexure in both the weapon mounting structure and the part of the host vehicle to which it is attached. Contemporary methods used in the weapon stabilization field focus on the locking of the weapon aim point through mechanical means, which can mitigate or eliminate the effects of pitch, roll, and yaw once the weapon is aimed, but require the systems to be remotely operated. For mechanically locking systems, the problem of relative translational motion of the host and target is ignored at best, and can be exacerbated under worst-case operational targeting scenarios. Some methods mitigate the effects of weapon mounting structure flexibility, but none do so in a time-dependent manner, explicitly and predictably compensating differently, say, for the first shot in a burst of weapon fire than for the second, third, etc.

In the example of a stabilized weapon mount that needs to accurately and precisely aim at a target while its platform is moving, the weapon provides a relatively predictable magnitude of angular pitch and elevation inaccuracy due to systematic characteristics of the weapon, weapon mount, environment, and firing timeline (e.g., rate of fire, shots fired, etc.), but the magnitude of angular pitch and elevation inaccuracy due to platform and target relative movement often overwhelms systematic inaccuracies. What is needed by the operators of these weapon systems is a stabilization subsystem that maintains the original aim point of the weapon at its target so that motion-induced inaccuracies can be mitigated or eliminated. Further elimination of systematic inaccuracies can result in a weapon system that, even on a moving platform, has greater accuracy and precision of targeting and projectile delivery than a stationary weapon system that is either not stabilized or uses conventional stabilization techniques. Layering additional capabilities such as fusing weapon aim point control with sensor target identification, ranging, and kinematic leading calculations provides means to reduce target tracking inaccuracies as well. This further enhances weapon efficacy, reduces collateral damage, and lowers operational costs for ammunition and weapon maintenance.

Present un-stabilized crew-served weapon mounts are inappropriate for engaging "point" targets (i.e., having small angular size as measured from the point of reference of the weapon) from a moving platform. Present un-stabilized mounts are often mounted to land vehicles, boats, ships, and aircraft, but they can only be used as area effect weapons, as the dispersion of rounds is measured in tens (if not hundreds) of milliradians under typical engagement operating conditions. This angular spread can be effective for suppressing fire intended only for encouraging enemy combatants to find hard cover, but to reliably engage targets out to the full effective range of the weapon, stabilization is required. Along with reliable and repeatable target engagement capability, minimizing collateral damage is becoming increasingly important. Without stabilization, the vast majority of the rounds will be far from the intended target and with higher likelihood of damaging allied or noncombatant personnel and property.

These limitations are especially pronounced when the host platform is a boat or ship with open projectile travel paths, and where errant rounds maintain lethal energy for many kilometers.

Existing limitations of conventional weapon stabilization systems can be overcome by deploying systems designed to gather platform movement data, then employing the present subject matter to process this data and transmit control commands to electrical actuators to adjust the aim point of the weapon to compensate for the movement of the platform. Additional adjustments can be further added to account for many other systematic inaccuracies such as projectile drop, weapon mount flexure, target tracking inaccuracies such as kinematic leading, and other inaccuracies that can be modeled/measured and subsequently predicted. By employing the present subject matter, the predictions of these inaccuracies can be used in addition to the platform motion sensor data in the calculation of control commands to adjust the aim point for these systematic and target tracking inaccuracies as well as motion-dependent inaccuracies. Further incorporation of operator-dependent data, the location of allies and noncombatants, and other data of relevance in the calculation of the control commands can further improve weapon accuracy and precision of projectile delivery and reduce collateral damage during operations.

The problem is challenging, as traditional stabilization systems use the same motors/actuators and drive train used for gross platform motion as they do for fine weapon stabilization. Such approaches are economical for the development of remote-operated equipment, but for a manned crew served weapon, the operational limitations and needs are very different. A generally preferred operational concept is for the operator to manually slew the weapon to a target, engage stabilization, and then use the stabilization actuators for fine aim adjustment. The rapid and safe transition between free motion and stabilized motion with fine aim adjustment requires a new and non-obvious type of stabilization system. While some remote mounts have had the option to completely disengage the drive train and enable manual operation as an option considered only in emergency situations, the new approach of the present subject matter is to have both free-gunning and stabilized modes available at all time throughout a mission, and readily toggled at the press of a button. When a crewman releases the weapon or otherwise releases control over its motion or aim point, an additional desirable mode of operation is to securely stabilize the weapon in its direction prior to release, or to stabilize and move the weapon to a previously determined "safe" position. Layering on additional capabilities and integration with user and sensor systems adds further operational benefits to crew-served weapons and other weapon and sensor mounts.

Stabilization and accuracy requirements increase when a weapon is fired towards a target that is moving at or near friendly forces, non-combatants, innocent civilians, and/or objects and terrain features of increased value and risk (e.g., a civilian cargo ship behind a maritime target, or a civilian suburban structure that might contain non-combatants near a ground target). In asymmetric warfare, these types of engagement scenarios are more common than not, as irregular forces understand the value of cover, rapid relative movement, and general unacceptability of friendly fire, non-combatant casualties, and collateral damage. Conventional mechanical stabilization techniques are ill-suited to address typical scenarios combining systematic, motion-based, and target tracking inaccuracies.

According to various implementations of the currently disclosed subject matter, a stabilization subsystem architecture and sensor processing method can provide control commands that address challenging weapon accuracy and precision requirements. The primary means by which this is accomplished is to have a subsystem physical architecture that includes a weapon affixed to a mount with two or more degrees of freedom, such as azimuthal rotation about a horizontal plane and elevation to raise the angle between the weapon barrel and the horizontal plane. A set of sensors will capture the data of the platform as it moves, and will send this information to a processing unit. The processing unit will generate control commands that are sent to the actuating mechanisms that can drive the weapon's effective aim point in two or more degrees of freedom.

An important part of the system level is the presence of the operator him or herself, who is responsible for providing the control commands to enable and disable the stabilization mechanism, to fire or stop firing the weapon, to move the weapon to a new aim point or towards a new target when stabilization is not active, and to provide other sensory input and other control commands to the weapon system and its stabilization subsystem. When the operator is not presently operating a crew-served weapon or other payload, this, too, can be important actionable data, as the weapon or payload can be stabilized to hold its position awaiting the return of the operator or some other control command, or moved to a previously determined safe state or position (which may also include an electronic fire lock to prevent accidental discharge). This architecture is provided to be a reference for a typical implementation of the many possible implementations of the present subject matter, and is not meant to be restrictive in terms of how it can be used by a designer skilled in the art of weapon mount or control electronics.

This subject matter stabilizes weapons in a different manner than other weapon stabilization systems, so engineering discipline must be applied judiciously when deciding whether or not to employ the present subject matter, and in deciding how the weapon is to react if the system encounters an operational fault, damage, or powers down. Different weapons on different mounts on different vehicles, or even the same type of weapon, weapon mount, and vehicle used for different missions may have different operational requirements for how and when the stabilization system is to react and power down.

There are a number of general concepts in weapon targeting and stabilization, whereby sensors aid in the detection, location, and alerting to the presence of enemy forces, weapon threats, endangered personnel, and other objects of critical interest, and a weapon mount is slewed to a target. The following description first discusses the fundamentals of the weapons with respect to ranges, powers, materials, and other characteristics of stabilization systems in these applications. The description then follows with a functional means by which a weapon can be stabilized by employing sensors, actuators, and processors through the descriptive use of figures and detailed discussions of these figures. The description then continues and finishes with details of a specific implementation of this subject matter.

Weapon stabilization methods according to some implementations of the current subject matter could be used in weapon systems for small arms, sensors, and delivery systems for less-than-lethal projectiles/agents using low to moderate power (for example, M231 Firing Port Weapons in stabilized mounts consuming between 5 W and 1 kW depending on sensor and actuator configuration). Such stabilized weapon mounts would employ low-power actuators for adapting the aim point of the weapons but would have large throws (between 10 and 30 degrees) to compensate for large relative platform and target movements. Targeting precision of a few milliradians would be sufficient for most of these implementations, as the effective range of most small arms and less-than-lethal projectiles and agents is typically limited to a few hundred meters. One example with longer range but similar targeting precision requirements would include an optical laser dazzler intended to temporarily disorient or blind an enemy combatant, criminal, or other person with an advanced risk profile.

Weapon stabilization methods according to other implementations of the current subject matter could be used in weapon systems for light-class weapon mounts using a moderate amount of power (for example, M2HB .50 caliber machine guns in a crew-served tripod weapon mount consuming between 50 W and 5 kW depending on sensor and actuator configuration). Such stabilized weapon mounts would employ low-power actuators for adapting the aim point of the weapons but would have moderate throws (between 5 and 20 degrees) to compensate for platform and target movements. At higher power levels, targeting precision of sub-milliradian accuracy in pitch and elevation can be achieved and is desirable for engaging targets at 500 m to 2 km for kinetic penetrators, shaped charge warheads, and other projectiles with a zero/small effective kill radius.

It is further recognized that applications demanding opposing requirements of higher precision and higher speed of adjustment in a system employing these methods may require more accurate sensors through redundancy, improved sensor elements and/or processing, additional sensors for target identification and tracking, and other advances. Such a system might also require more powerful actuators and/or more advanced receiver hardware and processing techniques than those suggested herein. Use of weapon stabilization methods according to some implementations of the current subject matter in weapon systems firing certain medium-class weapons may consume considerable power of 10 kW or more, but could enable effective precision of sub-milliradian pitch and elevation accuracies in delivery of kinetic penetrators and other anti-armor/structure munitions at effective operable ranges of several km even under adverse targeting and engagement conditions.

Throughout this description, possible physical and electrical characteristics for elements of a system employing methods according to the subject matter described herein have been suggested. An illustrative example of the current subject matter includes discussion of stabilizing the M2 .50 caliber machine gun and its many variants, which represent a category of crew-served and platform-mounted light weapons used worldwide. However, it will be readily understood from the following description and figures that a wide range of other small arms, light-class, and medium-class weapons and weapon mount types, including fixed vehicle mounts, can be stabilized in a similar manner by modifying sensors, actuators, processors, architectures, processing techniques, inputs, and/or algorithms.

A weapon stabilization system employing one or more implementations of the current subject matter can include elements for sensing the movement of a platform, for processing the data from these sensors, and for powering actuators to counteract the calculable effects of the platform's movement on the aim point of a weapon. While reference is made to crew-served light-class weapon mounts, other types of weapons, sensors, accessories, and mounts can also be stabilized.

FIG. 1 is a schematic illustration of a crewman 1 manning a weapon 10 mounted on a vehicle platform 2 that is traveling over uneven terrain 3. The weapon has an area of effect 4 though it is nominally directed at a target aim point 5. The area of effect 4 represents the area that a projectile is likely to pass through at the range of the target aim point 5, and is presented as a 90% radius in this example, meaning 90% of the projectiles fired will travel through a circle in space defined by this radius when at the range of the target. This area of effect will grow at longer range, and will often not be circular, although a defined angular radius of effect in many implementations will remain somewhat constant throughout the effective range of a given weapon and weapon mount so long as motion, target, ammunition, environment, and other conditions remain constant.

The crewman 1 controls the weapon 10 at the weapon grip 11 configured near the rear of the weapon 10, so it functions as a crew-served weapon. The weapon 10 is mounted to an elevating assembly 12 which is actuated by an elevating actuator mechanism 13. The elevating actuator mechanism 13 is attached to a rotating assembly 14, which is actuated by a rotating actuator mechanism 15. The rotating actuator mechanism 15 is mechanically coupled to the vehicle platform 2.

Figure 2:
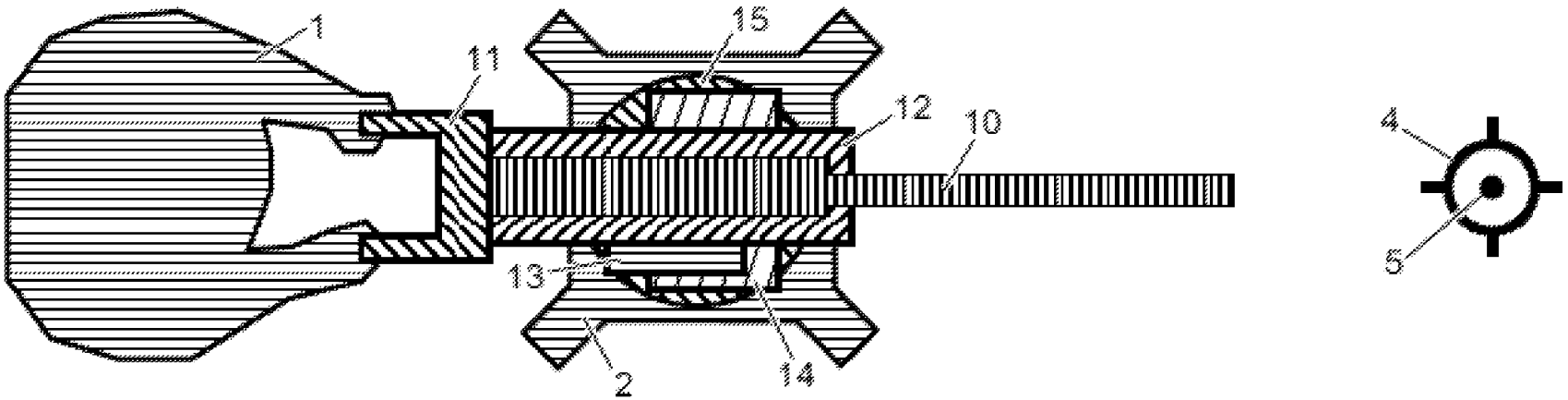
FIG. 2 is a plan-view schematic illustration of the example crew-served weapon and stabilized weapon platform of FIG. 1, showing the configuration of the actuators and mechanical elements.

The configuration of the attachment between the various elements of FIG. 1 is shown in the plan-view illustration of FIG. 2, which illustrates the identical crewman 1 operating the same weapon 10 mounted on the same vehicle platform 2. The weapon 10 is controlled by the weapon grip 11, and mounted to the elevating assembly 12 which is actuated by the elevating actuator mechanism 13 seen to the operator's right side of the weapon (lower part of FIG. 2) in this configuration. The elevating actuator mechanism is mechanically coupled to the rotating assembly 14, which is itself actuated by the rotating actuator mechanism 15 further coupled to the vehicle platform 2.

At this point, it is instructive for the reader to consider the detailed definitions of the various reference frames of weapon systems, their targets, and the manner in which relative reference frames are used to define weapon control objectives. When a weapon system is stabilized, the most basic mode of operation is to counteract any angular motion of the platform relative to the inertial reference frame of the Earth's surface. Although the Earth's surface is not a universal or "true" inertial reference frame due to the rotation of the Earth, the orbit of the Earth in the solar system, and the orbit of the Sun in the Milky Way galaxy, it can be approximated as a stable inertial reference frame during the relatively short timeframe of a crew served weapon burst. Here after, the Earth's surface reference frame will be referred to as the inertial reference frame. In this basic stabilization mode, the unit vector (or ray) defining the aiming direction of the weapon in the inertial reference will not change. While the weapon may translate laterally, the weapon aiming direction will remain parallel to the aiming vector when stabilization is enabled.

There is an alternate second mode of operation where the stabilization loop is configured to track a point in space within the inertial reference frame. There are a number of different ways to implement the control loop necessary for this operation. The most common implementations use gyroscopes and accelerometers, collectively referred to as an inertial measurement unit (IMU) and a processing system to integrate the data and determine the location, attitude, and motion of the vehicle within the inertial reference frame. The IMU, processor, and optionally additional sensors (e.g., GPS) are often packaged together into an inertial navigation system (INS). The INS data is then combined with a target's absolute position within the inertial reference frame (e.g. a latitude/longitude/elevation coordinate), or with the original target's relative direction and range to determine the azimuth and elevation attitude required to keep the weapon aiming at the target. In this second stabilization mode, therefore, the weapon stays aiming at a fixed point in space (instead of in a fixed direction in space).

There is a similar third mode of operation where the stabilization loop is configured to track a specific target in space. There are numerous methods of implementing the stabilization loop to include target movement information and movement prediction, including video target trackers, radar trackers, on-board INS with real-time target telemetry, etc. In all of these implementations, the weapon system aims at a specific moving point in space (instead of in a fixed direction in space or at a fixed point in space). This third mode of operation is more complex in definition and implementation, in that a weapon system that always points right at a target has very little chance of hitting the target due to bullet drop, windage, and target tangential motion as previously detailed, and that a different point in space is actually the true "target" for the weapon. This different point in space must be calculated based on available knowledge of the target's characteristics (which can include type, movement, engagement pattern history, likely future movement, etc.) as well as the conventional aspects of range, environment, platform motion, weapon system, etc. An accurate brief description, therefore, would be that this mode of operation aims at continuously moving points in space that are, over time, predicted to be likely to intercept a moving target in space.

An entirely different mode of operation where the stabilization loop is configured to aim the weapon in a designated direction relative to the host platform when it ceases to be under the control of an operator. In many implementations, this loss of control is identified by the release of one or both hands from the weapon grip, in turn activating one or more dead-man switches (a.k.a. live-man controls, enabling switches, vigilance buttons, etc.) When operating in this mode, the stabilization loop will command the weapon or other payload to either hold its present position or to move at a controlled speed to a pre-determined aim direction similar to one of the other stabilization modes previously described. A common safe position that may be pre-determined in some implementations is to have the weapon pivot upwards and away from the platform and likely allies (sometimes referred to as "port high"), but other safe positions may be preferred in certain implementations, and may even vary by the mission and even dynamically during a mission (e.g., a position aiming away from allies or non-combatants in the area). In some implementations, for example, a single hand release may cause the weapon to stabilize in its presently aimed direction, whereas both hands released may cause the weapon to move to it's safe position. In some other implementations, for example, a single hand release will cause the stabilization to disengage, whereas release of both hands will cause the weapon to stabilize in its presently aimed direction. In some implementations of the present subject matter, a fire lock or safety trigger may be engaged when the operator loses partial or total control of the payload, preventing accidental discharge.

The detailed description of the implementation of the present subject matter in FIG. 1 continues with a discussion of the function of the moveable elements and how they interact with the payload. The rotating actuator mechanism 15 performs part of the end role of moving the weapon aim point relative to the platform. In many implementations of this subject matter, this movement is essentially rotation about an axis that passes through some region of the physical space also occupied by the rotating actuator mechanism 15. In some other implementations of this subject matter, this movement is essentially rotation about an axis laterally removed from the physical space occupied by the rotating actuator mechanism 15 (which may also be a large radius compared to the size of the vehicle platform 2). In yet other implementations, this movement is essentially linear translation.

The movement of the rotating actuator mechanism 15 is generally assumed to be in the lateral plane relative to the vehicle platform 2, and this assumption is illustrated in every example provided in the diagrams of the present subject matter. In some implementations, however, the movement of the rotating actuator mechanism 15 will be in the vertical plane relative to the vehicle platform 2. In such implementations, the relative use of the words "azimuth" and "elevation" may be transposed or modified with respect to orthogonality or lack thereof without reducing the value or relevance of the present subject matter. In yet other implementations, the movement will be in a plane that is at some other angle or combination of angles of pitch, yaw, and/or roll of the vehicle platform 2. Such implementations might be preferred, for example, when the weapon mount and/or vehicle have a mechanical propensity to move along one or more non-Euclidean axes. In such implementations, the use of the words "elevation" and "azimuth" may be used in reference to the mounting or actuation directions, or may be used in reference to the original vehicle or vehicle platform 2 orientation. Care must be taken by the engineer implementing the present subject matter to ensure the design properly references direction and orientation.

As with the rotating actuator mechanism 15, the elevating actuator mechanism 13 also performs part of the end role of moving the weapon aim point relative to the platform. In some implementations of the present subject matter, the elevating actuator mechanism 13 will be responsible for movement that is largely orthogonal to the movement performed by the rotating actuator mechanism 15. In typical implementations therefore, this means it will move the weapon aim point in elevation or the "up and down" direction rather than in azimuthal or "left and right" direction. In many implementations, this movement is performed by rotation about a horizontal axis. The axis of rotation will, in many implementations, pass through some region of physical space also occupied by the elevating actuator mechanism 13. In some implementations, the movement of the weapon aim point will be due to lateral actuator movement incorporating a rotation about an axis removed from the elevating actuator mechanism 13 or, in extreme cases, about an axis removed from the vehicle platform 2 altogether.

In a similar manner as with the rotating actuator mechanism 15, the physical plane of movement will sometimes not be orthogonally referenced to the vehicle platform 2, the vehicle on which it is mounted, the weapon, or to the other actuator mechanism. In some implementations, the planes of reference will move throughout operation. An example of when such an implementation would be of value is if the present subject matter were used to stabilize the weapons in a ball turret used in an anti-aircraft application, as the weapon aim points and actuator reference planes/axes will continuously move throughout operation.

In some implementations of the present subject matter, the direction of movement performed by the elevating actuator mechanism 13 will not be orthogonal to the rotating actuator mechanism 15, and in fact, have movements that are partially complementary and/or anti-complementary. This may be a preferred implementation in applications where the two primary directions of movement of the platform and weapon are in non-orthogonal directions, such as a nominally vertical axis of a ground vehicle driving over a bumpy road, and the partially vertical and partially horizontal recoil response of a Mk 19A automatic grenade launcher. This may also be a preferred implementation in applications where space, weight, power, and/or cost constraints preclude the implementation of largely orthogonal actuators by those skilled in the arts of stabilized subsystem and/or weapon mount design.

The elevating actuator mechanism 13 and rotating actuator mechanism 15 will typically be specified based on the force needed to move the weapon aim point, the speed that this force needs to be applied and removed, and the angular and/or linear length of movement (travel) required. This will impact the mechanical size, weight, distribution, and electrical interface requirements of voltage, current, waveforms, and control commands. Together these elements will affect implementation details, application limits, operational limits, and cost of each unit, including cost of goods, installation, and maintenance.

The range of typical power consumption and movement throw length has already been discussed for a range of weapon types and applications, and these can generally be correlated to the requirements for selecting the performance specifications for the elevating actuator mechanism 13 and rotating actuator mechanism 15 by those skilled in the art of mechanical and electrical control subsystem design. The range of required waveforms and control commands spans the range of past, present, and reasonably extended future electrical powers, voltages, currents, ramp rates, phases, and coding schemes used by electrical engineers skilled in the arts of power management and/or control systems.

The physical size of the elevating actuator mechanism 13 and rotating actuator mechanism 15 in some implementations will be between one millimeter and ten centimeters for each enclosing dimension of small subsystems. An example would be a small-form unmanned vehicle mount with a compact small-arms weapon or less-than-lethal agent delivery system (e.g., Taser electrodes, tranquilizer dart, or pepper spray). In many implementations, the elevating actuator mechanism 13 and rotating actuator mechanism 15 may range in enclosing dimension size from five centimeters to one meter, as might be used on a crew-served light-class weapon mount on a ground, water, or air vehicle. In some implementations, the elevating actuator mechanism 13 and rotating actuator mechanism 15 may range in enclosing dimension size between 25 centimeters and four meters, as might be used on a medium class weapon mounted on a ground, water, or air vehicle or a forward operating base.

The elevating actuator mechanism 13 and rotating actuator mechanism 15 are likely to incorporate materials of a sort typically used in electrical actuator manufacturing. These include the category of materials generally referred to as dielectrics, generally having poor, low, or no measurable electrical conductivity. As well known to those skilled in the art of electrical engineering, this category includes materials such as many plastics, glasses, resins, ceramics, and composites such as FR-4 and fiberglass. This category also includes electroactive materials such as lead-zirconium titanate and other piezoelectrically or thermoelectrically active materials and composites, which are commonly known to those skilled in the art of actuator design.

The elevating actuator mechanism 13 and rotating actuator mechanism 15 are also likely to incorporate one or more members of a category of materials generally known as metals. As well known to those skilled in the art of electrical engineering, this includes materials with both high and low electrical and thermal conductivity, such as aluminum, titanium, gold, copper, nickel, iron, silver, platinum, and a wide variety of alloys including but not limited to many types of steel and magnetic ferrites.

Active and passive control components used in the construction of the elevating actuator mechanism 13 and rotating actuator mechanism 15 may include materials from the category typically referred to as semiconductors. This category includes silicon, silicon-germanium, gallium-arsenide, gallium-nitride, and a wide variety of other materials and metamaterials whose electrical properties change in the presence of an electric field or other electromagnetically or optically-induced effect, condition, or environment.

FIGS. 1 and 2 illustrate the mechanical assembly of one implementation of the current subject matter, but do not present the physical details of the sensors attached to the platform 2 that generate and transmit data to the system processor. In this implementation, a set of sensors for measuring platform include sensors for measuring acceleration in all three Cartesian coordinates (x, y, and z relative to their mounting position in FIG. 1, but in other implementations may be some other set of partially or generally orthogonal directions referenced to a direction selected by the designer) as well as gyroscopic measurement of pitch, yaw, and roll acceleration (similarly relative to their mounting position in FIG. 1, but in other implementations may similarly some other set of partially or generally orthogonal directions appropriately referenced). The set of sensors in FIG. 1 is mounted to the vehicle platform 2, and measure the acceleration of the platform in all six conventional axes using the vehicle platform 2 as a reference for all six axes.

The system implementation of the current subject matter illustrated in FIGS. 1 and 2 includes the transmission of the data generated by the sensors to the weapon stabilization processor. The processor analyzes the data from the sensors and develops control commands based on the sensor data considering physical and dynamic nature of the weapon 10, the ground vehicle platform 2, and other mechanical and control elements. The control commands are sent to the elevating actuator mechanism 13 and rotating actuator mechanism for the express purpose of actively countering the acceleration and physical movement of the platform with respect to its change on the aim point of the weapon. Note that this is not necessarily the same as counteracting the movement itself, as certain types of motion will have no significant change on the aim point of the weapon, and other types of movement will change the aim point in an indirect and non-linear (though still calculable and estimable) manner. This difference is a discriminating characteristic of active stabilization control compared to conventional passive mechanical stabilization techniques and remote weapon gyrostabilization techniques.

As an example of operation, assume the crewman 1 of FIGS. 1 and 2 is aiming his weapon 10 generally forwards from the point of view of the forwards motion of the vehicle on which his platform 2 is mounted. If the vehicle and mounted platform 2 is accelerating in an upwards pitch (i.e., nose rising) direction, for example, the sensor responsible for measuring pitch would detect the change, send the data to the processor, which would then control commands for the elevating actuator mechanism 13 to actuate in the downward direction. The resulting effect will be that the weapon will maintain its original aim point that it had before the platform moved. If the stabilization mode were turned off, then the compensation control commands would not have been created and the weapon would have aimed upwards when the platform itself angled upwards. An equivalent description of movements can be performed with each of the types of motion that the platform can experience, with all of these motions detected by sensors, with data sent to the processor, which then calculates control commands to counteract the effects of this movement with respect to the originally identified and selected aim point of the weapon.

It is recognized that, in some implementations of the current subject matter, fewer sensors could be used than the six axes of measurement provided for in the implementation illustrated in FIGS. 1 and 2. For example, in ground vehicle applications, acceleration in the forwards or backwards direction relative to the weapon's instantaneous aiming direction will generally have negligible impact on the delivery of projectiles, as shots are fired far faster than the motion of the platform. Instead of mounting two sensors to measure planar motion (e.g., x and y accelerations) of the platform, a single sensor can be used on the subsystem at a location after the rotating actuator mechanism 15. Example locations include, but are not limited to, physical attachment to the elevating assembly 12, elevating actuator mechanism 13, or rotating assembly 14. Similar analyses can be performed on combining other sensor functions for a particular application to reduce the complexity, size, weight, cost, and power consumption of many implementations of the current subject matter. It is presently calculated that as few as two sensor axes could provide the data needed for some implementations of the current subject matter, although many implementations will use four or more sensor axes to provide higher levels of sense/control precision and resultant operational weapon accuracy and projectile delivery precision.

It is also recognized that, in many implementations of the current subject matter, other types of sensors and data elements will also be incorporated into the algorithm for calculating the control commands, such as crew characteristics, temperature, range to the target, type of ammunition used, target acquisition, identification, and tracking data, etc., but these are not further detailed with examples in the detailed embodiments of the present subject matter. Addressing these other elements of data and their contributions is the responsibility of the engineer skilled in the art of weapon system design, integration, and operational characterization.

In FIGS. 1 and 2, the weapon 10 is an M2HB .50 caliber machine gun. This weapon 10 is comprised of materials generally included in the categories of dielectrics and metals as previously described for the elevating actuator mechanism 13 and rotating actuator mechanism 15, and has enclosing feature sizes ranging from several centimeters to about two meters. The materials and sizes of weapons capable of being mounted in other implementations of the present subject matter can be based on designs used by those skilled in the art of small arms, light class weapons, medium class weapons, and less-than-lethal armaments. Materials will also generally be comprised of dielectrics and metals as previously described. Sizes range by weapon class and type, from several millimeters for small projectile and gas projector subsystems to several meters for chain guns, rapid-fire cannon, and other medium class weapons. The design, architecture, and accessories of the weapons themselves (and their ammunition) is left to those skilled in the art.

The weapon grip 11 is generally comprised of a variety of materials that are likely to include multiple types of dielectrics, metals, and semiconductors as previously described. The grip itself contains a large number of capabilities and control components for the operator, which will be further discussed in the detailed description of the implementation example of FIG. 6. The general size of a weapon grip 11 is between a few centimeters for a personal small arms implementation up to several tens of centimeters for a typical control station for a stabilized medium-class weapon mount. The general size of the buttons, sensor displays, and other features of a weapon grip 11 will range between a fraction of a millimeter and ten centimeters or more.

The vehicle platform 2, elevating assembly 12, and rotating assembly 14 may be manufactured of a wide variety of metallic, dielectric, and/or composite materials using a wide variety of architectures and designs in accordance with the state of the art in rugged mechanical structure design and manufacturing technologies. Typical elements are likely to be comprised of one or more types of stainless steel, plastic, resin-based composite, titanium, or aluminum alloys for high strength, light weight, and reasonable cost depending on each application and implementation of the present subject matter. For example, the elevating assembly 12 may include elements such as a weapon cradle, commonly a part of many crew-served weapon mounts, and this cradle is often itself a combination of steel mechanical elements, springs, and fasteners performing the functional role of mechanically coupling the weapon and its mount. The size ranges of the platform 2, elevating assembly 12, and rotating assembly 14 used with the present subject matter can, in some implementations, be in the same ranges as those described for the elevating actuator mechanism 13 and rotating actuator mechanism 15.

In the application of FIGS. 1 and 2, the target aim point 5 represents the point in space required for a projectile to generally intercept an intended target, which in this example is an up-armored truck at a range of 500 meters known to contain enemy combatants. In general, target aim points will be located above and in front of a moving target, and will be based on ballistic drop and kinematic leading of the target. In the application of FIGS. 1 and 2, the area of effect 4 is defined by a circle with a radius of five milliradians, which is typical for a crew-served weapon under good firing conditions and capable of engaging a vehicular target at several hundred meters or more. In this example, a five milliradian inaccuracy represents 2.5 meters at a distance of 500 meters as a 90% confidence of shots fired passing through this circular area. Assuming a Gaussian spread, a 2.5 meter 90% radius of effect means approximately one third of the shots fired will strike the target vehicle, and about two-thirds of the shots fired will miss.

The current subject matter can include passive and/or active recoil compensation. Mechanical passive recoil suppression can be combined with active recoil counteraction based on predicted weapon response and/or real-time sensed response. The active recoil counteraction can be performed using the same electrical actuators used for counteracting the target aim point movement due to platform motion and other types of inaccuracies identified in this subject matter.

Figure 3:
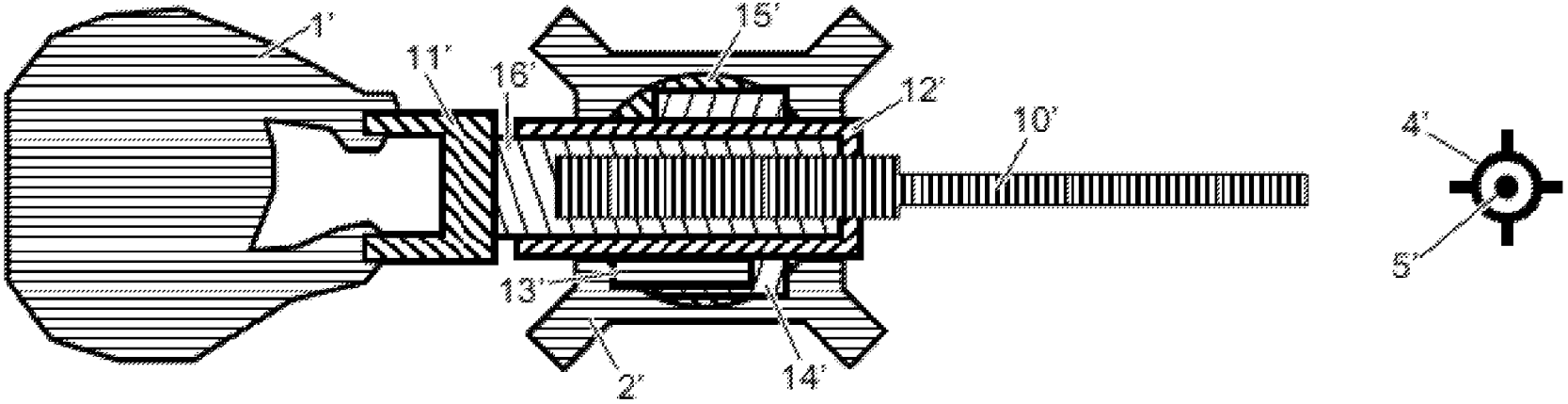
FIG. 3 is a plan-view schematic illustration of an alternative example of a crew-served weapon and stabilized weapon platform that includes a recoil dampening device for improved (reduced) radius of dispersion.

FIG. 3 depicts a schematic illustration of a stabilized M2HB mount developed under the present subject matter to include a mechanical passive recoil suppression element along with active recoil suppression algorithms. An operator 1' manning an M2HB 10' mounted on a Bradley turret 2'. The weapon has a precision area 4' nominally directed at a fine aim point 5'. The operator 1' controls the M2HB 10' at the stabilization grip 11', so it functions as a crew-served weapon as with the example of FIG. 2. The M2HB 10' is mounted to a recoil compensator 16' which is itself mounted to an elevating structure 12' actuated by an elevating motor 13'. The elevating motor 13' is attached to a rotating structure 14', which is actuated by a rotating motor 15'. The rotating motor 15' is mechanically coupled to the Bradley turret 2'.

The material composition and size of the Bradley turret 2', M2HB 10', stabilization grip 11', elevating structure 12', elevating motor 13', rotating structure 14', and rotating motor 15' of FIG. 3 are similar to those of the vehicle platform 2, weapon 10, weapon grip 11, elevating assembly 12, elevating actuator mechanism 13, rotating assembly 14, and rotating actuator mechanism 15 of FIG. 2. The material composition and size of the recoil compensator 16' is similar in nature to these elements as well, being comprised of the categories of materials known as dielectrics and metals, and being in the enclosing size range of several centimeters to many tens of centimeters.

The greatest differences between the implementations of FIGS. 2 and 3 are seen in the effects of recoil compensation. The implementation of FIG. 3 contains passive mechanical recoil compensation provided by the elastic properties of the recoil compensator 16' in the primary axis of recoil from the H2HB 10' (e.g., backwards spring). The recoil compensator 16' has two primary mechanical effects on recoil, being a dissipation of energy as well as the dampening of response to slow down the physical impulse of reactive force that is translated to the elevating structure 12' as compared to the rapid translation of reactive force to the elevating assembly 12 of the implementation seen in FIG. 2. The incorporation of some sort of passive mechanical recoil compensation is often seen in light class weapons, and almost always provided for in crew-served medium class weapons. The effects of energy dissipation are to reduce the amount of mechanical impulse that must be compensated for by the stabilization subsystem. The effects of the dampening of time response of the impulse is to reduce the maximum impulse power requirements for the actuators of the stabilization subsystem, so that smaller, less powerful, and generally less expensive actuators can be specified by the designer to improve the procurement and operational cost effectiveness of the system.

The implementation of FIG. 3 also includes an improved algorithm that actively compensates for the recoil of the weapon when fired. The sensors detect when the weapon is fired, and proactively adjust the control signals delivered to the elevating motor 13' and rotating motor 15' to compensate for the movement of the aim point due to recoil. The passive mechanical recoil compensator 16' slows down the mechanical impulse response of the weapon's recoil, which eases the load on the actuators to accomplish this task. The end result of the incorporation of a combination of active and passive recoil compensation in the implementation of FIG. 3 is that the precision area 4' is significantly smaller than the area of effect 4 of the implementation shown in FIG. 2. The radius of effect is decreased from 5 milliradians to 2.5 milliradians, which corresponds to about 1.25 meters at 500 meters range. When fired at a target such as an up-armored passenger vehicle, the M2HB 10' of FIG. 3 will hit with 90% of all rounds fired, as opposed to the 33% of rounds fired by the weapon 10 of FIG. 2.

Figure 4:
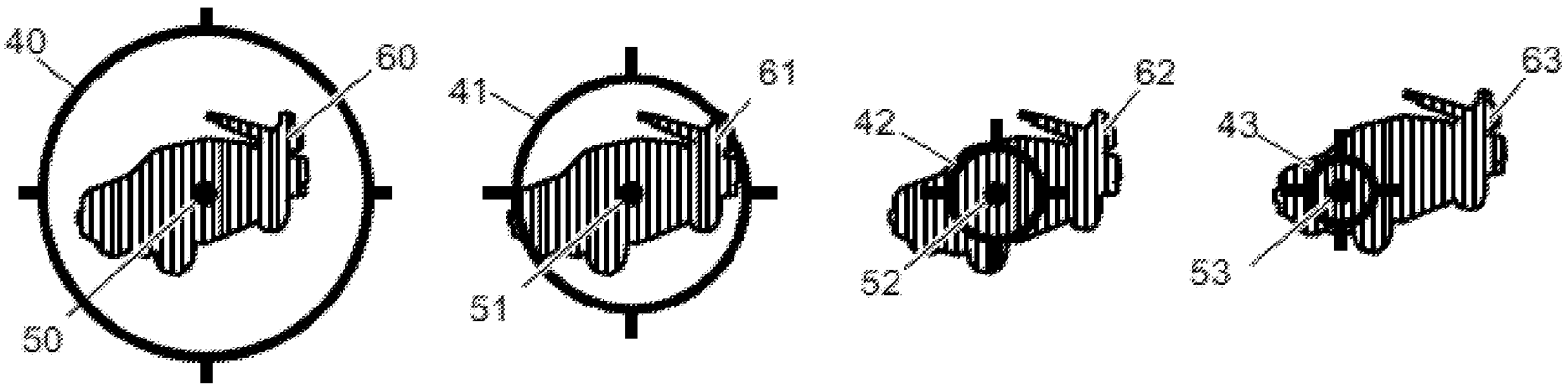
FIG. 4 is a schematic illustration of four different weapon radii of dispersion and how they correlate to risk of collateral damage near (and beyond) a given target, risk of harm to nearby allied forces and non-combatants, number of rounds fired compared to rounds on target, and the relative consumption of ammunition and other resources to achieve a desired effect.

The effective difference in rounds-on-target is illustrated in FIG. 4, which depicts four identical up-armored passenger vehicle targets at a range of 250 meters, about half the distance previously discussed in the examples of FIGS. 1, 2, and 3. This represents a common engagement distance when fighting irregular forces in suburban, rough, or moderate terrain. The first image depicts a first aim point 50 at the passenger compartment of a first vehicle 60 with a first radius of effect 40. The first radius of effect in this example is shown to represent approximately 15 milliradians (3.8 meter radius at 250 meters), representative of reasonably good conditions for firing an un-stabilized crew-served weapon as might be seen with a stationary idling vehicle, good firing conditions, and a highly trained and focused operator without distraction. Approximately 20% of the rounds fired will be likely to strike the target, with about half of these hits likely to hit target elements that are critical to the function of the vehicle (wheels, crew compartment, weapon systems, etc.) and causing concern for its crew. Unfortunately, most of the rounds fired will still strike objects beyond and around the target.

The second image depicts a second aim point 51 at the passenger compartment of a second vehicle 61 with a second radius of effect 41. The second radius of effect in this example is shown to represent approximately 10 milliradians (2.5 meter radius at 250 meters), representative of very good conditions for firing a crew-served weapon as might be seen with recoil compensation and/or conventional stabilization techniques. Approximately 50-55% of rounds fired will strike the target, with half likely to hit critical elements, although many rounds fired will still pass through the area to strike targets beyond.

The third image depicts a third aim point 52 at the passenger compartment of a third vehicle 62 with a third radius of effect 42. The third radius of effect in this example is shown to represent approximately 5 milliradians (1.25 meter radius at 250 meters), which might be seen in an implementation of the present subject matter as fired under moderate to severe operational conditions. Almost all rounds fired will strike the target, with the vast majority of these likely to hit critical elements and with a minimum of potential collateral damage.

The fourth image depicts a fourth aim point 53 at the engine block of a fourth vehicle 63 with a fourth radius of effect 43. The fourth radius of effect in this example is shown to represent approximately 2.5 milliradians (0.6 meter radius at 250 meters), which might be seen in an implementation of the present subject matter as fired under moderate conditions, perhaps with single shots or short controlled bursts of weapon fire. Essentially, every round fired will strike the target in a critical system of the operator's choice with very little chance of collateral damage. From an operational point of view, this fourth example is the targeting precision desired by allied forces to engage enemy combatants in regions with high concentrations of non-combatants. Such an example provides a tactical overmatch condition where allied forces can engage and selectively destroy enemy forces without exposing themselves or innocents to significant risk.

High precision delivery of projectiles and munitions comes with a previously undisclosed disadvantage. When a projectile is highly likely to hit at or near your target aim point, then the target aim point must have been accurately positioned in the first place prior to firing, or you will actually have a lower chance of hitting a target than you would as when you had worse precision. This concept is readily described by the schematic illustration of FIG. 5, which shows a weapon crewman 101 firing a stabilized weapon 110 from a mounting platform 102 where both the mounting platform 102 and the intended target 162 are traversing rugged terrain 103. The weapon crewman 101 slewed his weapon towards the intended target 162, and engaged stabilization at an initial aim point 105 that is close to but not overlapping the intended target 162. Unfortunately, the first dispersion area 104 is so precise that there is effectively no chance that rounds fired will strike the intended target 162. The weapon crewman 101 cannot fire upon the target; such a scenario is commonly encountered with prior stabilization systems that must engage stabilization, verify aim point, disengage stabilization, re-aim, and re-engage stabilization multiple times.

Figure 5:
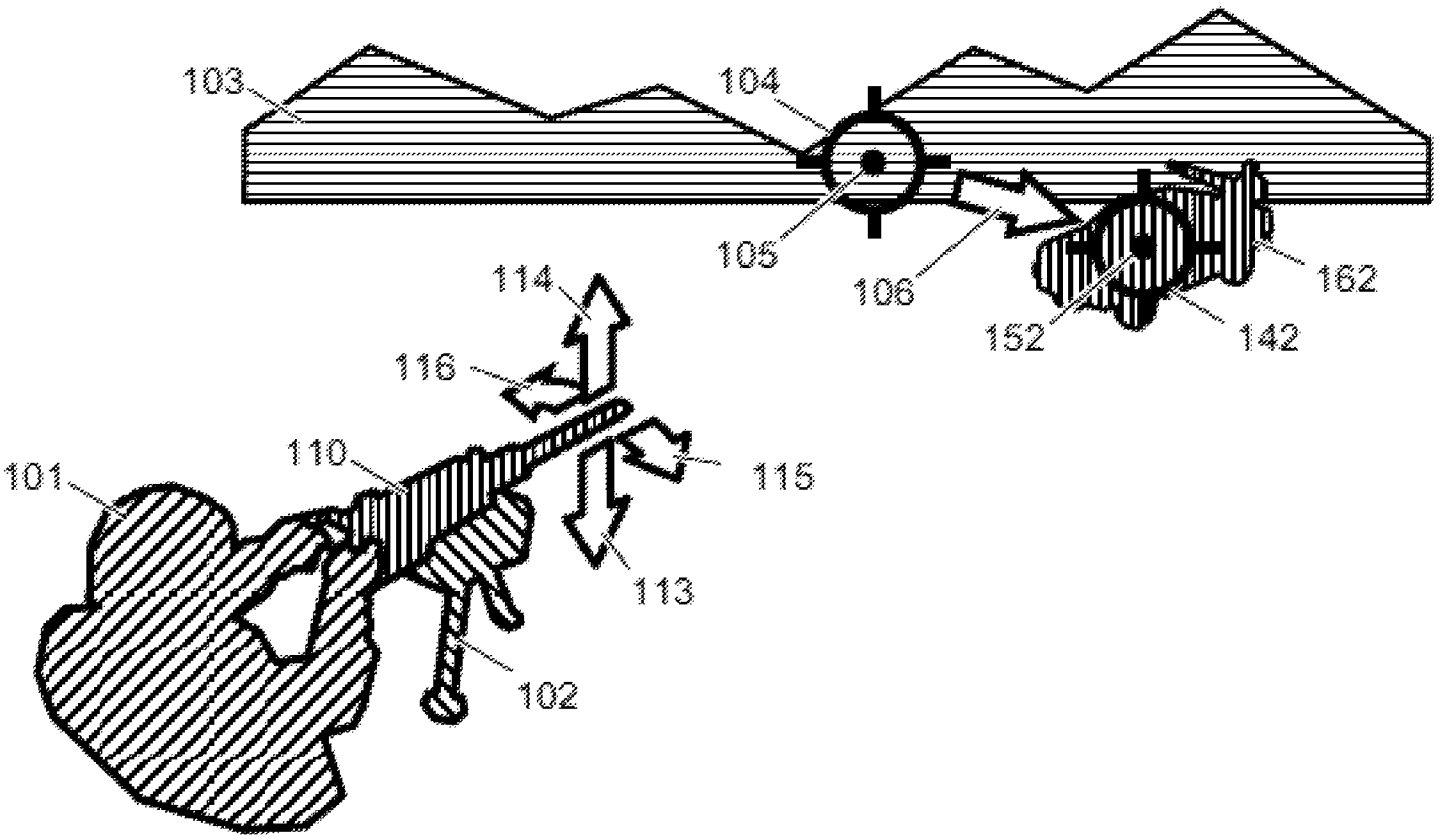
FIG. 5 is a schematic illustration of the operational use of separate control signals to adjust a stabilized aim point to more precisely and effectively engage a target.

Fortunately, in the implementation of the present subject matter described by FIG. 5, the stabilized weapon 110 has been outfitted with an additional capability required to solve the weapon crewman 101's problem. This additional capability is the ability to adjust the aim point of the stabilized weapon 110 while still being actively stabilized for motion-induced, target tracking, and systematic inaccuracies. By engaging a control on his weapon grip, the weapon crewman 101 can adjust the stabilized aim point in elevation down 113, elevation up 114, azimuth right 115, and azimuth left 116. In the example of FIG. 5, the weapon crewman 101 is able to command the stabilized weapon 110 to move slightly to the elevation down 113 and moderately to the azimuth right 115. This results in a traversed path 106 of the initial aim point 105 to a final aim point 152. The resultant final dispersion area 142 is shown to overlap the target appropriately and the weapon crewman 101 is able to fire.

Figure 6:
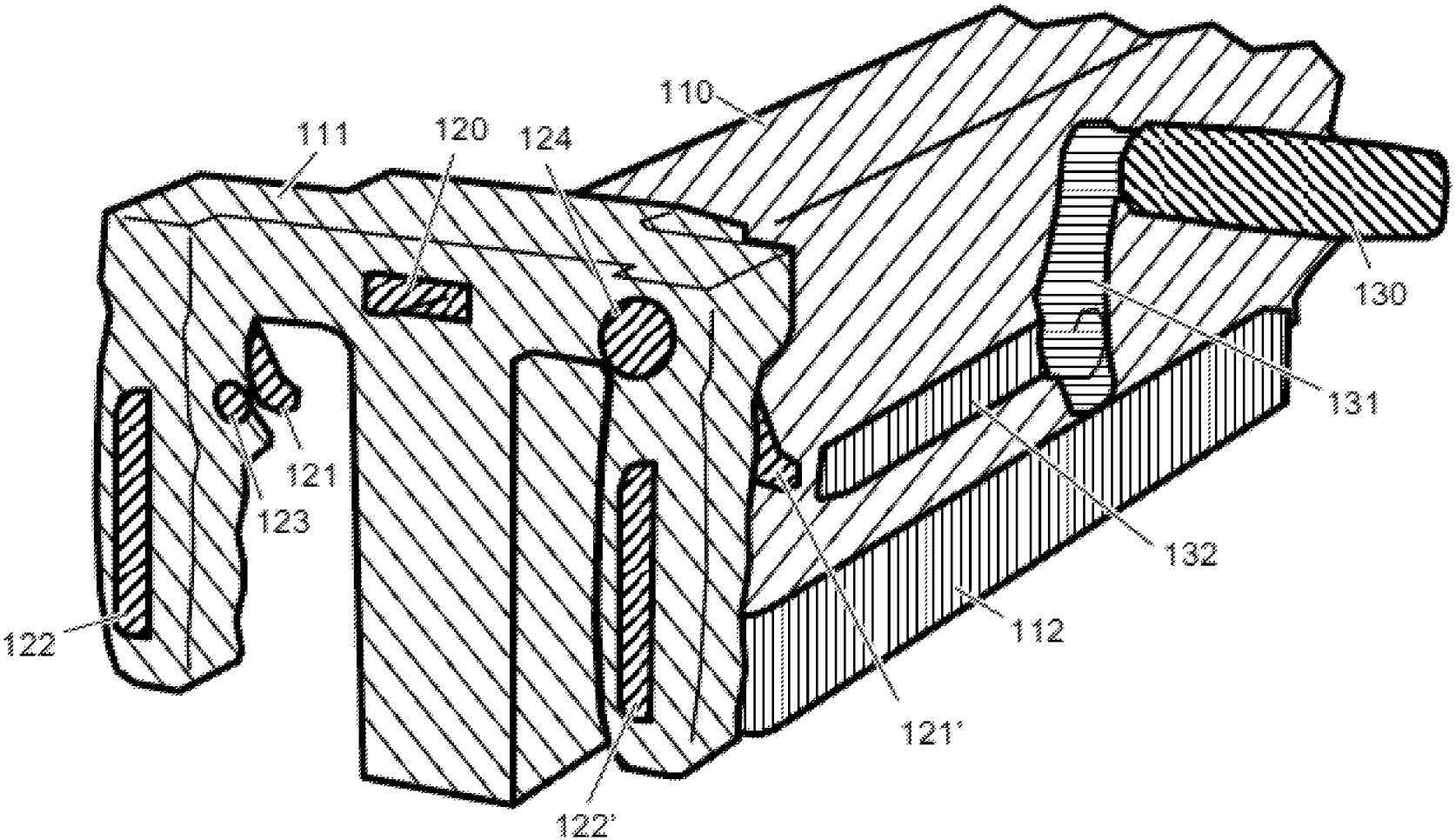
FIG. 6 is a schematic illustration of one implementation of a stabilized weapon grip with buttons, switches, and other user input devices.

The weapon control grip of the stabilized weapon 110 of FIG. 5 is magnified and schematically illustrated in FIG. 6. The stabilized weapon 110 is mounted to an elevating mount 112 which is intimately mechanically connected to a grip structure 111. The elevating mount 112 and grip structure 111 are configured to allow normal operation and freedom of movement of the stabilized weapon 110's controls, such as the charging handle 130, charging lever 131, and charging slot 132. Similar access to ammunition feed, barrel replacement, and other critical weapon functions and maintenance requirements not shown are provided without undue restriction.

The grip structure contains the primary firing and stabilization controls, starting with a safety selector switch 120 used to enable and disable the weapon trigger. This fire control enable may be either mechanically or electrically coupled to the weapon depending on the system used. The fire control enable of the M2HB, for example, is mechanically coupled to the safety selector switch 120, whereas the fire control enable of an M3P will be electrically coupled, as the trigger itself is electrical in nature. A left trigger 121 and a right trigger 121' will be active or disabled based on the position of the safety selector switch 120. Further safety controls include a left dead-man switch 122 and a right dead-man switch 122'. These switches must be held down (depressed) in the operator's grip in order to operate the stabilized weapon 110. If an operator is incapacitated, one or more of the dead-man switches will be released, and the unit will enter a safer operating mode to limit the danger to crew and others nearby.

The stabilization function is engaged and disengaged with the stabilization button 123 configured on the left handle of the implementation of FIG. 6. When stabilization is disengaged, the operator is in free-gunning mode. When stabilization is engaged, the weapon stabilizes the aim point to the best of its ability according to one of the three modes of relative aim point control previously described. It is envisioned that in alternative implementations of the present subject matter, multiple stabilization buttons or a single, multi-purpose button may be used to select between different modes of relative aim point control as well as toggle stabilization off to enable free-gunning.

An aim thumbwheel 124 is configured on the right hand grip, allowing for relative aim point adjustments while the weapon is stabilized. The operator has the option to use the aim thumbwheel 124 or disengage weapon stabilization and manually slew the weapon in a new direction to face and/or engage an angular-distant target.

In the first mode of operation, wherein the weapon stabilization subsystem is to maintain an aim vector, the aim thumbwheel 124 will adjust the weapons aiming direction and speed relative to the inertial reference frame. Commanding the weapon to aim left or right 10 degrees/second in this mode would not necessarily command the azimuth motor to move 10 degrees/second. If the host vehicle were rotating at 5 degrees per second, the azimuth axis would be commanded to move −5 degrees/second or 15 degrees/second.

In the second mode of operation, wherein the weapon stabilization subsystem is to maintain aim at a fixed location in space, the aim thumbwheel 124 adjusts the aiming direction and speed relative to the line segment defined by the weapon and the fixed point in space representing the aim point required to hit a fixed target point downrange.

In the third mode of operation, wherein the weapon stabilization subsystem is to maintain aim at a moving location in space so as to result in an increased probability to hit a moving target, the aim thumbwheel 124 adjusts the aiming direction relative to the line segment defined by the weapon and an initial point in space. The joystick adjusts the aiming speed relative to the instantaneous inertial reference frame of the target, or more generally, relative to the instantaneous speed required to keep the weapon aimed at the moving target.

In the implementation of FIG. 6, a separate power up and power down button for stabilization actuators and other powered elements of the weapon mount system is provided for elsewhere on the weapon platform rather than in the grip region.

Other implementations of the present subject matter may contain one or more additional controls. One or more buttons may be configured to select between or toggle different viewing capabilities, turning on and off a heads-up display unit, optical scope, screen overlay, or LED targeting lights on the grip or sighting element. Other controls may be added and configured to turn on and off ballistic correction, lead correction, and target tracking if these capabilities are present in a particular implementation. An additional control or controls may be added for each sensor or capability added to the weapon system for the operator to readily use these sensors and capabilities, whether or not these elements directly or indirectly provide data or other input to the stabilization algorithm.

The effects of stabilization engagement, disengagement, and fine aim adjustment are seen in the maritime application example of FIGS. 7A, 7B, 7C, and 7D. A stabilized weapon (not shown) is aimed towards a target boat 260 with a first aim point 252 and systematic inaccuracy 242. The dimensions of small boats and other commonly encountered targets may optionally be in the range of approximately 1 m to 50 m, which addresses typical small to medium sized water vessels of relevant interest including but not limited to rowboats, lifeboats, sailboats, motorboats, yachts, fishing boats, tugboats, patrol boats, and most pleasure craft. As with the example of FIG. 5, the first aim point 252 is not accurately placed, and the systematic inaccuracy 242 is too precise to enable any significant chance of hitting the target boat 260. This might represent the case of calm water and essentially ideal engagement conditions for both the operator of the stabilized weapon and for enemy combatants with long range small arms and light to medium class weapons.

Figure 7B:
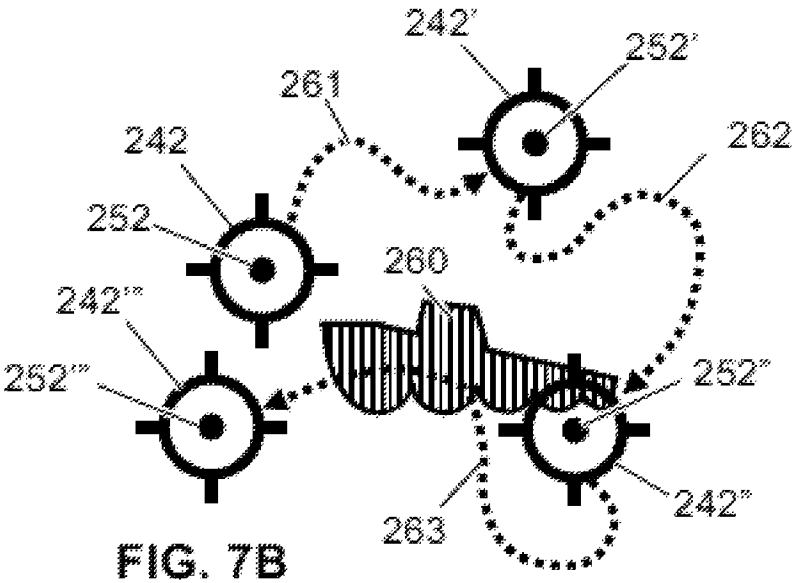
FIG. 7B is a schematic illustration of how the intrinsic angular spread moves around due to motion inaccuracies as well as other inaccuracies in an operational environment.
Figure 7A:
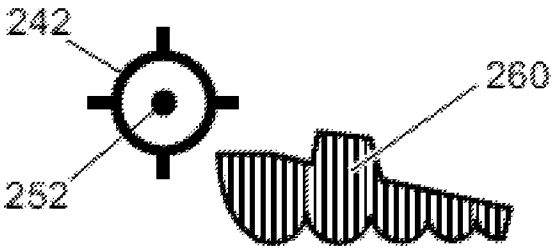
FIG. 7A is a schematic illustration of a nominal weapon aim point and small intrinsic angular spread caused by a subset of systematic inaccuracies.

As the wind and waves pick up in the scenario illustrated in this example, the targeting conditions are more accurately represented by the schematic illustration of FIG. 7B. The first aim point 252 and first systematic inaccuracy 242 is translated due to the motion of the platform along a first directional path 261 in a fraction of a second. The resultant second aim point 252' retains a nearly identical instantaneous radius of dispersion represented by the second systematic inaccuracy 242', which might vary from the first systematic inaccuracy 242 only due to intermediate wind, pressure, moisture, and temperature changes, which may be negligible effects at short ranges over short time periods. The end result of the translation is that the weapon still will not be able to hit the target boat 260 if fired. Similarly, another translation along a second path 262 results in a third aim point 252" and a third systematic inaccuracy 242", and then a translation along a third path 263 results in a fourth aim point 252' and a fourth systematic inaccuracy 242' all within what might be a single second or less.

The end result of the rapid translations and changes in the aim points is a generally similar average effective aim point 150 and average effective area of effect 240. The small comfort in this gross inaccuracy is that the target boat 260 might actually be hit if the weapon is fired during these rapid platform motions. A far more exaggerated version of FIG. 7C represents a typical condition of engagement for a crew-served weapon engaging a target at sea, where both platform and target are moving with significant vehicular motion with mild wind and wave conditions.

Figure 7D:
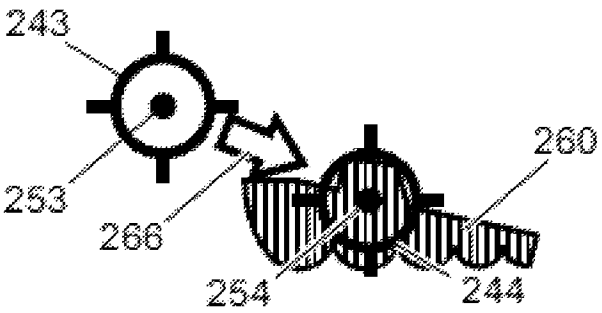
FIG. 7D is a schematic illustration of stabilization returning a weapon back to its intrinsic angular spread, then adjusting the aim point to effectively engage a target.
Figure 7C:
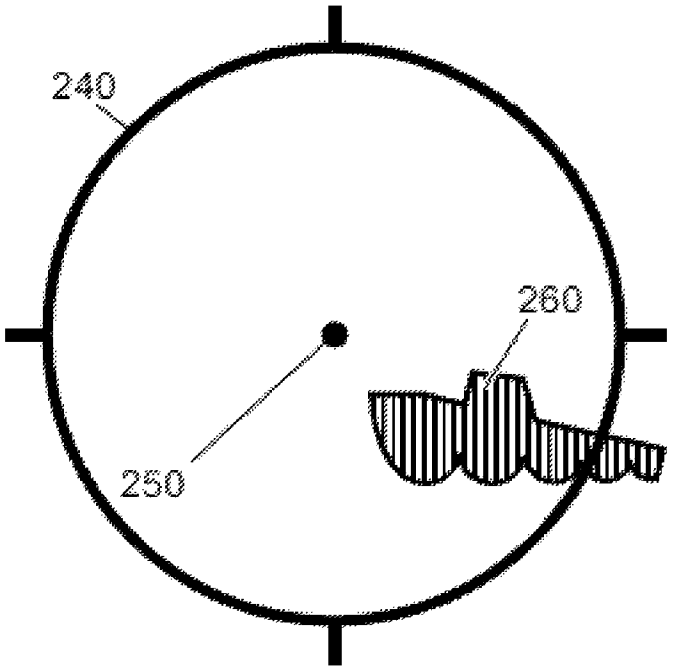
FIG. 7C is a schematic illustration of the total angular spread caused by the combination of inaccuracies in an operational environment.

In FIG. 7D, the stabilization is engaged, and the weapon aim point is recovered to a restored aim point 253 with its restored systematic inaccuracy 243. All of the motion of the platform and its attendant inaccuracies are eliminated by the stabilization subsystem. The operator then uses the fine aim adjustment to translate the relative stabilized aim to a finalized aim point 254 retaining its finalized systematic inaccuracy 244. The boat target 260 can then be fired upon with dramatically improved accuracy and precision as compared to the unstabilized case. The target will be struck with nearly all shots fired instead of less than 5% of shots fired.

Figure 8:
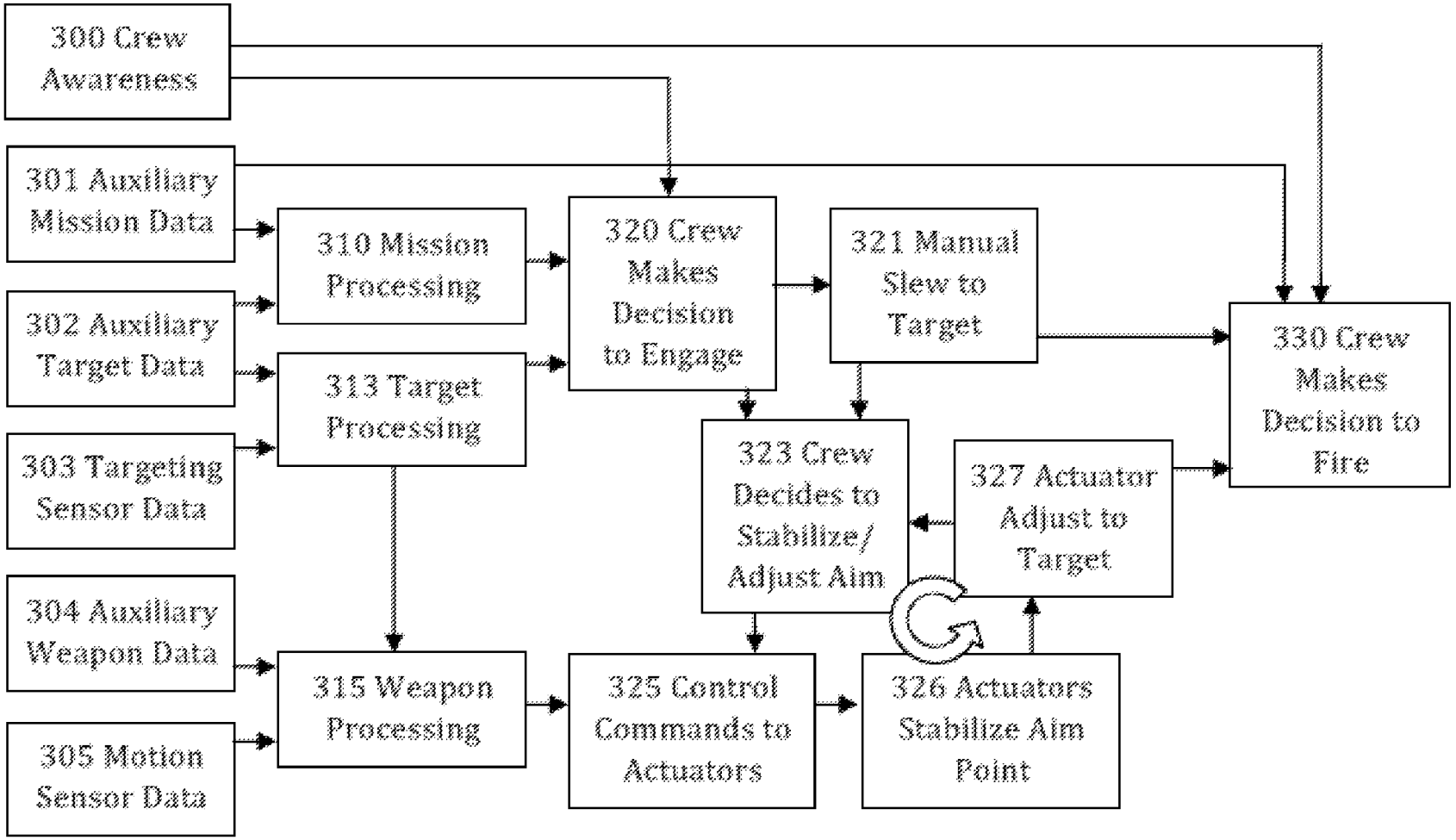
FIG. 8 is a schematic illustration of a block diagram of one implementation of a stabilized weapon platform.

One example of data flow and decision making by which the weapon crewman employs the modes of operation of one implementation of the present subject matter is schematically illustrated in the block diagram of FIG. 8. A critical input in this implementation is the combination of crewman senses, tactical understanding, mission data and goal, training target, object, and area knowledge, and situational awareness combined into an aggregate input referred to as 300 crew awareness. The crewman is responsible for making each ultimate decision to engage, fire, stabilize (and in which available mode of operation), and toggle each sensor and other weapon subsystem or capability based on overall 300 crew awareness along with input from a variety of other sources.

A body of available information about the mission, the location (and known/unknown presence, patterns, characteristics, etc.) of non-target objects such as civilian structures and non-combatant personnel in the area, environment, and a host of other data is available in many implementations of the present subject matter, with the aggregate of this non-target, non-weapon data referred to as 301 auxiliary mission data in this implementation. This data, along with the definitions of target characteristics, patterns, etc., provided as 302 auxiliary target data is provided as input to a processing capability for the purpose of 310 mission processing to convert known and projected data into potentially relevant and actionable information for the ultimate 320 crew makes decision to engage. In this implementation, this 302 auxiliary target data is also considered along with 303 targeting sensor data for 313 target processing, which assesses whether an object in a sensor field of view is a target of interest. This 313 target processing provides critical input into 320 crew makes decision to engage, as this data and processing path helps the crewman identify and track a target of interest, augmenting his own 300 crew awareness and relieving part of the cognitive burden of target tracking and characterization from the crewman, so that he or she may concentrate more capably on the decision whether or not to engage.

While the crewman of this continuing example implementation of the present subject matter is considering 320 crew makes decision to engage, the sensing and processing assets of the stabilized weapon system will already be at work. A body of data about the weapon, its ammunition, mount, platform, and other information will be provided to the stabilization subsystem as 304 auxiliary weapon data. The motion sensors on board the platform, weapon, and/or mount will provide the 305 motion sensor data to the processor as well. These data sets will be provided for 315 weapon processing, which determines the desirable stabilization and aim point information required to engage a target based on the target's type, location, motion, and other information provided by the 313 target processing. All of this can be calculated before or during the crewman's decision-making process whether or not to engage a particular target. In the case of multiple potential targets having been identified, the 315 weapon processing may pre-emptively develop sets of desirable weapon control commands that would be any one, multiple, or all targets identified so that when the decision to engage is made, the system will be ready as fast or faster than the crewman.

When the crewman decides to engage, he or she must make the determination whether or not they wish to 320 manual slew to a target, or whether they wish to 323 crew decides to stabilize/adjust aim. In the case of manual slew, the crewman then further has the decision to 330 crew makes decision to fire or whether to then turn on the stabilization for improved accuracy or aim point adjustment. The 330 crew makes decision to fire will also consider the 301 auxiliary mission data, whether provided as part of 300 crew awareness or as provided as a "reminder note" or other focus in a heads up display, reticle overlay, or other user interface.

During the process of manual slewing or engagement of a target with an aim point already near to the present aim point, it is probable that in this implementation of the present subject matter that the 323 crew decides to stabilize/adjust aim. At this point, the stabilization subsystem processor delivers commands based on the 315 weapon processing as 325 control commands to actuators. These control commands are sent to the actuator drivers, which then drive in a manner resulting in 326 actuators stabilize aim point. The actuators are then further commanded and driven by the system and the crewman to make appropriate adjustments to aim the weapon at the appropriate point that are likely to result in hitting the target and a minimum of other objects downrange. This is a recursive process driven in the direction shown by the curved arrow in this implementation of the present subject matter with respect to data flow and control command generation. As the processor continues to generate 325 control commands to actuators based on user input as well as the 315 weapon processing of 304 auxiliary weapon data, 305 motion sensor data, and 313 target processing. The stabilization subsystem will continue to stabilize and adjust the aim point during this process.

At some point in the process of aim and stabilization and adjustment, the aim point will be established with high confidence. Based on 300 crew awareness, additional 301 auxiliary mission data, and the 327 actuator adjusts to target, there will ultimately occur 330 crew makes decision to fire. Provided no fire inhibitor is presently engaged (e.g., safety select switch or ally identified to be in unacceptable risk profile) the weapon can then be fired. It is envisioned that in many implementations of the present subject matter, a fire inhibitor override would be available to a crewman to allow firing even in the case of high risk to allied forces and noncombatants should the mission profile and tactical conditions merit the risk.

In concrete terms in this (and many other) implementation of the present subject matter, a set of sensors will capture the 305 motion sensor data of the weapon, platform, and/or mount as it moves, and will send this information to a motion processing unit for 315 weapon processing. The processing unit will generate 325 control commands to actuators that are sent to the actuating mechanisms that can drive the weapon's effective aim point in two or more degrees of freedom, thus accomplishing the action of 326 actuator stabilizes aim point. An important part of the system level of this implementation is the presence of the operator him or herself, who is responsible for determining whether or not to engage a target (320), for providing the control commands to enable and disable the stabilization mechanism (323), to fire or stop firing the weapon (330), to move the weapon to a new aim point or towards a new target when stabilization is not active (321), and to provide other sensory input (300) and other control commands to the weapon system and its stabilization subsystem. This data flow and control command architecture is provided to be a description of one implementation of the many possible implementations of the present subject matter, and is not meant to be restrictive in terms of how the present subject matter can be used by a designer skilled in the art of weapon mount or control electronics.

In some implementations, optionally one or more of 301 auxiliary mission data and 302 auxiliary target data includes a library of target characteristics, movements, or other signatures can be empirically derived or modeled for a plurality of objects of interest (e.g., various civilian and armored ground vehicles, dismounted combatants of different types and training, adult civilians, children, naval vessels, strongpoints, etc.) so that sensor data can be compared to objects characterized in the library in order to determine whether the objects are present in a particular zone. The library can also include data characterizing directionality of the objects (i.e., facing, motion, range, and history of motion and other activity). The received sensor data can be modified, harmonized with other data, and/or analyzed to reflect factors that can be relevant to identification, such as physical location, activity, proximity to known civilian and/or combatant areas, and other factors.

In certain implementations of the present subject matter, advanced weighting algorithms may determine that one type of data set may provide more or less reliable data with respect to optionally one or more aspects of target resolution during 313 target processing and proper aim point prediction in 315 weapon processing. A different weighting and aim point correction algorithm may be used between different data sets, times (with different measured or predicted environmental conditions), operators, target types or patterns, or other characteristics. When a target is identified and being tracked, the user can be alerted, and the user can also be provided a description of the specific target detected and tracked, all extracted from received data signals. In this capacity, the fusion of the stabilization subsystem with a suite of sensors for situational awareness and target tracking algorithms and crewman interface can enable a significantly more capable weapon system. The enhanced weapon system may enable new types of mission profiles and tactical capabilities that rely on crew interaction with sensor data, target identification and tracking, and weapon stabilization.

Figure 9:
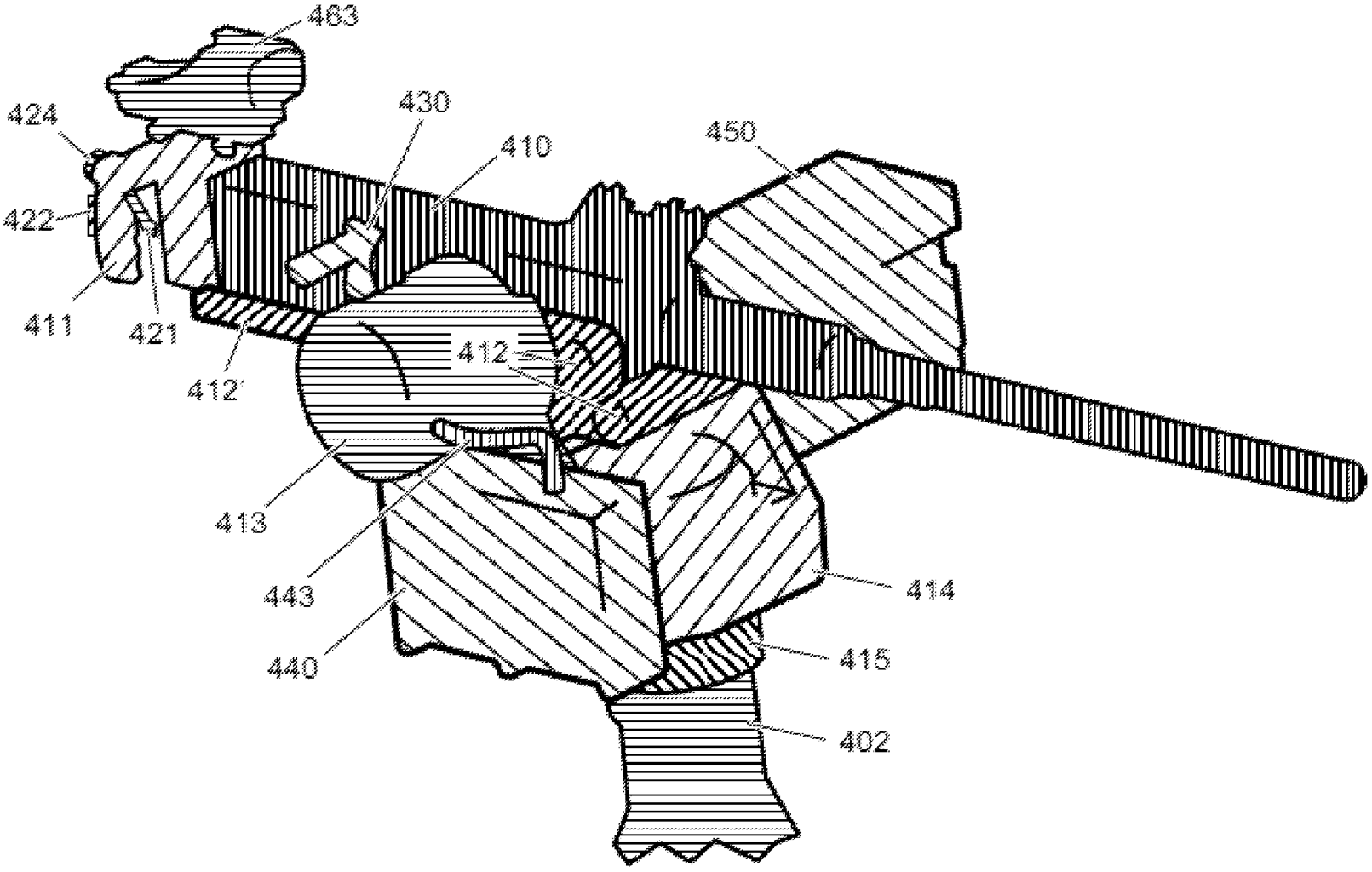
FIG. 9 is a schematic illustration of one implementation of a stabilized crew-served M2HB platform as configured for an example riverine application (gun shield removed).

An instructive example of a stabilized weapon system with a realistic isometric schematic illustration implementing the present subject matter is provided in FIG. 9. A machine gun 410 is mounted to an elevating cradle assembly 412 with rear cradle assembly region 412'. The elevating cradle assembly 412 is mounted to a tilt motor actuator 413 with housing, which contains the elevating actuator as well as relative motion sensors. The tilt motor actuator 413 has tilt motor cabling 443 to the processing unit 440, through which data, power, and control commands pass between the sensors, actuators, processors, and drive circuitry contained within. The processing unit 440 contains relative motion sensors within, as well as motor drivers, a processor for generating control commands, power circuitry, and other critical electrical circuits for the stabilization subsystem. The tilt motor actuator 413 is connected to the rotating mount 414, allowing the weapon to turn about the central axis of the rotating motor 415 in both free-gunning and stabilized modes. The rotating motor 415 mechanically couples the entire assembly to the weapon mount base 402, which itself contains additional absolute and relative motion sensors housed within with cabling connections to the processor (sensors and cables not visible in view of FIG. 9).

The weapon controls are configured so as to not interfere with conventional machine gun 410 operation, but provide additional stabilization and other capabilities in accordance with the present subject matter. The ammunition magazine 450 is attached to the side of the weapon in a conventional manner, and the charge handle 430 is similarly unobstructed by the additional elements providing stabilization, processing, and control. A machine gun grip 411 provides the crewman ready access to the various switches, buttons, and other controls. One fire trigger 421 can be seen in the view of FIG. 9, as can one dead-man button 422 and the fine aim joystick 424. Other buttons and controls, such as stabilization engage and target tracking buttons are not visible in FIG. 9. An optical sight 463 has been attached to the machine gun grip 411, providing optical image enhancement for the crewman, as well as weapon system status and target tracking indicators.

One or more aspects or features of the subject matter described herein can be realized in digital electronic circuitry, integrated circuitry, specially designed application specific integrated circuits (ASICs), field programmable gate arrays (FPGAs) computer hardware, firmware, software, and/or combinations thereof. These various aspects or features can include implementation in one or more computer programs that are executable and/or interpretable on a programmable system including at least one programmable processor, which can be special or general purpose, coupled to receive data and instructions from, and to transmit data and instructions to, a storage system, at least one input device, and at least one output device. The programmable system or computing system may include clients and servers. A client and server are generally remote from each other and typically interact through a communication network. The relationship of client and server arises by virtue of computer programs running on the respective computers and having a client-server relationship to each other.

These computer programs, which can also be referred to as programs, software, software applications, applications, components, or code, include machine instructions for a programmable processor, and can be implemented in a high-level procedural language, an object-oriented programming language, a functional programming language, a logical programming language, and/or in assembly/machine language. As used herein, the term "machine-readable medium" refers to any computer program product, apparatus and/or device, such as for example magnetic discs, optical disks, memory, and Programmable Logic Devices (PLDs), used to provide machine instructions and/or data to a programmable processor, including a machine-readable medium that receives machine instructions as a machine-readable signal. The term "machine-readable signal" refers to any signal used to provide machine instructions and/or data to a programmable processor. The machine-readable medium can store such machine instructions non-transitorily, such as for example as would a non-transient solid-state memory or a magnetic hard drive or any equivalent storage medium. The machine-readable medium can alternatively or additionally store such machine instructions in a transient manner, such as for example as would a processor cache or other random access memory associated with one or more physical processor cores.

To provide for interaction with a user, one or more aspects or features of the subject matter described herein can be implemented on a computer having a display device, such as for example a cathode ray tube (CRT) or a liquid crystal display (LCD) or a light emitting diode (LED) monitor for displaying information to the user and a keyboard and a pointing device, such as for example a mouse or a trackball, by which the user may provide input to the computer. Other kinds of devices can be used to provide for interaction with a user as well. For example, feedback provided to the user can be any form of sensory feedback, such as for example visual feedback, auditory feedback, or tactile feedback; and input from the user may be received in any form, including, but not limited to, acoustic, speech, or tactile input. Other possible input devices include, but are not limited to, touch screens or other touch-sensitive devices such as single or multi-point resistive or capacitive trackpads, voice recognition hardware and software, optical scanners, optical pointers, digital image capture devices and associated interpretation software, and the like.

In the descriptions above and in the claims, phrases such as "at least one of" or "one or more of" may occur followed by a conjunctive list of elements or features. The term "and/or" may also occur in a list of two or more elements or features. Unless otherwise implicitly or explicitly contradicted by the context in which it is used, such a phrase is intended to mean any of the listed elements or features individually or any of the recited elements or features in combination with any of the other recited elements or features. For example, the phrases "at least one of A and B;" "one or more of A and B;" and "A and/or B" are each intended to mean "A alone, B alone, or A and B together." A similar interpretation is also intended for lists including three or more items. For example, the phrases "at least one of A, B, and C;" "one or more of A, B, and C;" and "A, B, and/or C" are each intended to mean "A alone, B alone, C alone, A and B together, A and C together, B and C together, or A and B and C together." In addition, use of the term "based on," above and in the claims is intended to mean, "based at least in part on," such that an unrecited feature or element is also permissible.

The subject matter described herein can be embodied in systems, apparatus, methods, and/or articles depending on the desired configuration. The implementations set forth in the foregoing description do not represent all implementations consistent with the subject matter described herein. Instead, they are merely some examples consistent with aspects related to the described subject matter. Although a few variations have been described in detail above, other modifications or additions are possible. In particular, further features and/or variations can be provided in addition to those set forth herein. For example, the implementations described above can be directed to various combinations and subcombinations of the disclosed features and/or combinations and subcombinations of several further features disclosed above. In addition, the logic flows depicted in the accompanying figures and/or described herein do not necessarily require the particular order shown, or sequential order, to achieve desirable results. Other implementations may be within the scope of the following claims.

The invention claimed is:

1. An apparatus comprising:

a stabilization assembly comprising one or more gimbals configured to be moved in one or more directions relative to a host platform;

a payload cradle mounted to the assembly and configured to secure a payload mounted thereon;

two or more electrical motion control actuators;

one or more motion sensors sensing motion of the assembly in one or more inertial degrees of freedom;

a control processor electrically interfaced with the two or more electrical motion control actuators and the one or more motion sensors; and an interface selector control that enables selective switching between first and second operating modes during operation, wherein:

in the first operating mode, the control processor automatically commands the two or more electrical motion control actuators based on motion data provided by the one or more motion sensors to stabilize an aim point of the payload by correcting for changes in payload aim caused by motion, in the second operating mode, the control processor automatically commands at least one of the two or more motion control actuators to disengage such that the payload and its assembly may be freely slewed by an operator.

2. The apparatus of claim 1, wherein the interface selector control is mounted to the payload cradle or the payload.

3. The apparatus of claim 1, wherein the one or more gimbals are provided for selectively positioning the payload.

4. The apparatus of claim 1, wherein there are one or more payload controls provided for operation of the payload.

5. The apparatus of claim 4, wherein the one or more payload controls are mounted to or form part of the payload.

6. The apparatus of claim 4, wherein the one or more payload controls are mounted to or form part of the cradle or assemble.

7. The apparatus of claim 4, wherein the control processor determines, based on data received from the one or more motion sensors, whether or not an operator is manning the payload.

8. The apparatus of claim 7, wherein the control processor determines, based on the data received from the one or more motion sensors, whether or not the operator has one hand or two hands on the payload controls.

9. The apparatus of claim 1, wherein the one or more gimbal controls that are configured adjust the aim point of the payload while in the first operating mode.

10. The apparatus of claim 1, wherein the payload is a crew-served weapon.

11. The apparatus of claim 1, wherein the payload is a camera or a light source.

12. The apparatus of claim 1, wherein the one or more motion sensors comprise at least one sensor selected from a group consisting of: inertial navigation systems (INS), global positioning systems (GPS), global navigation systems (GNSS), magnetometers, inclinometers, range finders, and radar sensors.

13. The apparatus of claim 1, further comprising an environmental sensor measuring at least one attribute selected from a group consisting of: altitude, temperature, humidity, air pressure, wind conditions in direction and/or magnitude.

14. The apparatus of claim 1, wherein the host platform is secured to a moveable vehicle.

15. The apparatus of claim 1, wherein the host platform is subject to motion comprising (i) rotational motion, (ii) linear motion, or (iii) a combination of rotational and linear motion.

16. The apparatus of claim 1, wherein a first actuator comprises an elevation actuator, and a second actuator comprises an azimuth actuator.

17. The apparatus of claim 1, wherein a first motion sensor comprises an elevation sensor and the second motion sensor comprises an azimuth sensor.

18. The apparatus of claim 1, wherein the payload cradle has two degrees of freedom relative to the host platform comprising azimuth and elevation.

19. The apparatus of claim 1, wherein motion relative to Earth is measured as well as the motion of the payload relative to the host platform.

20. The apparatus of claim 1, wherein movement of the payload may be operated remotely by an operator.

21. The apparatus of claim 1, wherein the one or more motion sensors comprise a plurality of axis motion sensors comprising a gyroscope, an accelerometer, or a combination thereof.

22. The apparatus of claim 21, wherein the one or more motion sensors detect motion in at least one of six degrees of freedom comprising pitch, roll, yaw, x, y, or z.

23. The apparatus of claim 1, further comprising one or more target characterization sensors to generate data characterizing one or more of the motion, range, and speed of a target.

24. A method comprising:

initiating operation of stabilized platform in a first operating mode, the stabilization platform comprising:

a stabilization assembly comprising one or more gimbals configured to be moved in one or more directions relative to a host platform;

a payload cradle mounted to the assembly and configured to secure a payload mounted thereon;

two or more electrical motion control actuators;

one or more motion sensors sensing motion of the assembly in one or more inertial degrees of freedom;

a control processor electrically interfaced with the two or more electrical motion control actuators and the one or more motion sensors; and an interface selector control that enables selective switching between first and second operating modes during operation, receiving, by the interface selector, a signal or input switching to the second operating mode; and initiating operation of the stabilized platform in the second operating mode;

wherein:

in the first operating mode, the control processor automatically commands the two or more electrical motion control actuators based on motion data provided by the one or more motion sensors to stabilize an aim point of the payload by correcting for changes in payload aim caused by motion, in the second operating mode, the control processor automatically commands at least one of the two or more motion control actuators to disengage such that the payload and its assembly may be freely slewed by an operator.

* * * * *